US006301452B1

(12) United States Patent
Yoshizawa

(10) Patent No.: US 6,301,452 B1
(45) **Date of Patent: *Oct. 9, 2001**

(54) IMAGE FORMING APPARATUS

(75) Inventor: Ryuichi Yoshizawa, Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/503,743

(22) Filed: Feb. 15, 2000

(30) Foreign Application Priority Data

Feb. 16, 1999 (JP) ..... 11-037719
Feb. 8, 2000 (JP) ..... 12-030588

(51) Int. Cl.[7] ..... G03G 15/00

(52) U.S. Cl. ..... 399/45; 399/43; 399/389

(58) Field of Search ..... 271/226, 227, 271/242, 265.01, 265.02, 270, 196, 197; 399/43, 45, 66, 21, 388, 389, 394, 396, 67, 68, 322, 400; 219/216

(56) References Cited

U.S. PATENT DOCUMENTS 5,652,943 * 7/1997 Matsuo ..... 399/21
5,721,627 * 2/1998 Kamiya ..... 399/82
5,887,219 * 3/1999 Eom ..... 399/45
6,026,276 * 2/2000 Malachowski ..... 399/400

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

An image forming apparatus includes an image bearing member, an image forming device for forming an image on the image bearing member, an intermediate transfer member to which the image is transferred from the image bearing member, the image on the intermediate transfer member being transferred to a transfer material at a transfer position, a detecting sensor for detecting the kind of the transfer material, a conveying device for conveying the transfer material to the transfer position, the time from after the image starts to be formed on the image bearing member by the image forming device until the image on the image bearing member formed by the image forming device is transferred to the intermediate transfer member and arrives at the transfer position being longer than the time from after the kind of the transfer material is detected by the detecting sensor until the transfer material arrives at the transfer position by the conveying device, and a changeover device for selectively changing over a first mode for forming an image on the image bearing member by the image forming device on the basis of the kind of the transfer material detected by the detecting sensor, and a second mode for forming an image on the image bearing member by the image forming device on the basis of the result of the detection by the detecting sensor in the first mode irrespective of whether the kind of the transfer material is detected by the detecting sensor or not.

218 Claims, 14 Drawing Sheets

IMAGE FORMING APPARATUS

BACKGROUND OF THE INVENTION

1. Field of the Invention

This invention relates to an image forming apparatus using the electrophotographic process, and particularly to an image forming apparatus such as a copier, a printer or a facsimile apparatus.

2. Related Background Art

In an image forming apparatus wherein a toner image is formed on a transfer material, and the transfer material is heated and pressurized by a fixing device to fix the toner image on the transfer material to thereby effect image formation, the thickness and kind of the transfer material are very important factors in determining the quality of image.

In a fixing device for fusing a toner and fixing it on a transfer material, the greater is the thickness of the transfer material, the greater becomes the quantity of heat taken away by the transfer material during fixing and the smaller becomes the quantity of heat for fusing the toner. Thereby, the toner is not sufficiently fused and bad fixing occurs. Particularly in an image forming apparatus wherein developers of plural colors are superposed one upon another to thereby form a color image, as compared with a case where a monochromatic image is formed, the quantity of the toners put on a transfer material is greatly increased and therefore, the difference in thickness between transfer materials greatly affects an image. Therefore, in an image forming apparatus for forming color images, as compared with an image forming apparatus for forming monochromatic images, particularly strict control is required of the temperature of the fixing device.

When the transfer material is light transmissive resin for an overhead projector (hereinafter referred to as "OHT"), an image must be formed under image forming conditions (a transfer high-voltage, a process speed, a fixing temperature, etc.) differing from the conditions in the case of plain paper in order to improve the light transmittance of the image. Also, regarding a case where the transfer material is glossy paper having gloss, it is necessary to form an image under image forming conditions differing from those in the case of plain paper.

Heretofore, when printing is to be effected on other transfer material than plain paper, a user has given the information of an operating panel or a computer from the operating panel or the computer to the image forming apparatus, has changed image forming conditions such as the transfer high-voltage during the printing operation, and the speed of the fixing device or the printing operation speed, and has performed the printing operation under image forming conditions optimum for the kind of the transfer material used.

Here, the printing operation according to the conventional art will be described with reference to the flowchart of FIG. 13.

First, whether the information of the kind of the transfer material (whether it is OHT or thick paper) has been given by the user is judged (601), and when there is no user's designation, the temperature of a fixing device is started to be attempered so as to become a print temperature for default (602), and the image forming conditions for default are set (603), and after the fixing device has been attempered to the print temperature (606), the printing operation is started (607).

On the other hand, when there is user's designation, the attempering of the temperature of the fixing device is started so that the fixing device may be attempered to a print temperature conforming to the thickness of the transfer material designated by the user (604), and after image forming conditions conforming to the thickness of the transfer material designated by the user are set (605), the fixing device waits until it is attempered to the set print temperature (606), and the printing operation is performed under the set image forming conditions (607).

However, in the printing operation as described above, when the user determines control conditions, i.e., image forming conditions, on the basis of the information of the transfer material inputted from the operating panel or the computer and performs the printing operation under the control conditions, the user may input wrong information and in that case, there has been the problem that a bad image is created.

SUMMARY OF THE INVENTION

It is an object of the present invention to provide an image forming apparatus which can effect image formation well in conformity with the kind of a transfer material and can also prevent any reduction in the throughput of image formation.

Other objects of the present invention will become apparent from the following detailed description when read with reference to the accompanying drawings.

DESCRIPTION OF THE PREFERRED EMBODIMENTS

Embodiment 1

Figure 1:
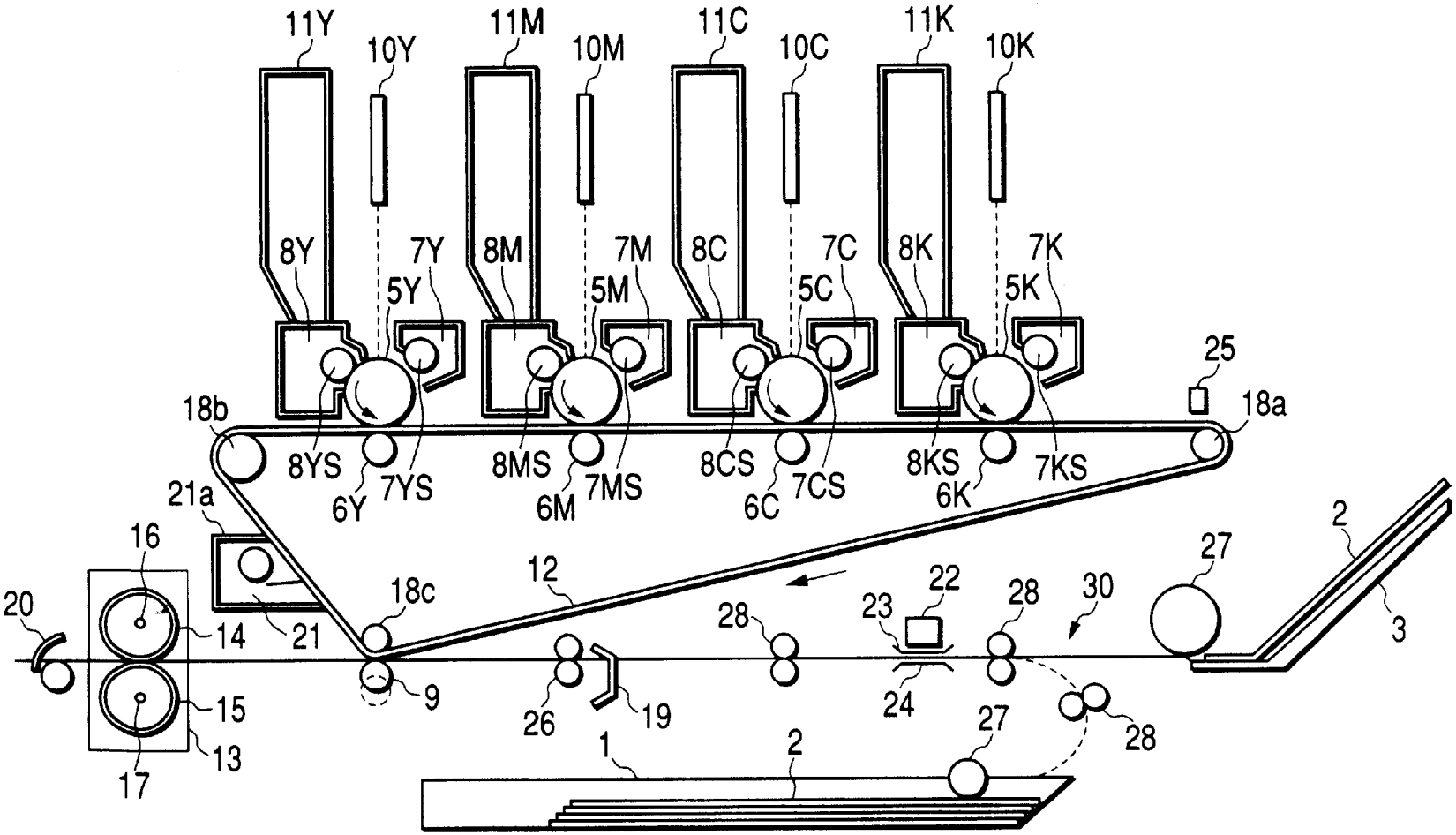
FIG. 1 shows a construction of a laser printer which is an image forming apparatus according to a first embodiment of the present invention.

FIG. 1 shows an embodiment of the image forming apparatus of the present invention. The image forming apparatus of this embodiment is a color laser printer.

The color laser printer of the present embodiment forms electrostatic latent images by image light formed on the basis of an image signal in an image forming portion, develops these electrostatic latent images to thereby form visible images, transfers these visible images onto an intermediate transfer member in superposed relationship with one another to thereby make them into a color visible image, further transfers this color visible image to a transfer material which is a recording medium, and then fix the color visible image.

The image forming portion is comprised of photosensitive drums 5Y, 5M, 5C and 5K as image bearing members at stations juxtaposed correspondingly to developing colors, primary chargers 7Y, 7M, 7C and 7K as charging means, developing devices 8Y, 8M, 8C and 8K as developing means, toner cartridges 11Y, 11M, 11C and 11K detachably mountable to the main body of the apparatus, an intermediate transfer member 12, a transfer material feed portion, a transfer portion and a fixing portion.

Each of the photosensitive drums 5Y, 5M, 5C and 5K is comprised of an aluminum cylinder and an organic photoconductive layer applied to the outer periphery thereof, and is rotated by the driving force of each drive motor transmitted thereto, and each drive motor rotates each of the photosensitive drums 5Y, 5M, 5C and 5K in a counterclockwise direction in conformity with the image forming operation. The exposure lights to the photosensitive drums 5Y, 5M, 5C and 5K are sent from scanners 10Y, 10M, 10C and 10K as exposing means, and the surfaces of the photosensitive drums 5Y, 5M, 5C and 5K are selectively exposed, whereby electrostatic latent images are successively formed.

As charging means, provision is made of the four primary chargers 7Y, 7M, 7C and 7K for charging the photosensitive drums 5Y, 5M, 5C and 5K of yellow (Y), magenta (M), cyan (C) and black (K) at the respective stations, and the respective chargers are provided with sleeves 7YS, 7MS, 7CS and 7KS.

A voltage (negative polarity) applied to the chargers 7YS–7KS during charging is controlled by a CPU in conformity with the kind of the transfer material (the discrimination between the kinds of the transfer materials is the discrimination as to whether the transfer material is light-transmissive resin, or thick paper, or glossy paper, in contrast with plain paper).

The exposure speed of the photosensitive drums by the scanners 10Y–10K is also controlled by the CPU as control means in conformity with the kind of the transfer material.

As the developing means, provision is made of the four developing devices 8Y, 8M, 8C and 8K for effecting the development of yellow (Y), magenta (M), cyan (C) and black (K) at the respective stations, and the developing devices are provided with rotary developing sleeves 8YS, 8MS, 8CS and 8KS. Each of the developing devices is detachably mounted to the main body of the apparatus.

A voltage (negative polarity) applied to the developing sleeves 8YS–8KS during development is controlled by the CPU in conformity with the kind of the transfer material.

The intermediate transfer member 12 is an endless belt passed over a driving roller 18*a* and driven rollers 18*b* and 18*c*, is in contact with the photosensitive drums 5Y, 5M, 5C and 5K, is rotated in a clockwise direction during color image formation, is rotated with the rotation of the photosensitive drums 5Y, 5M, 5C and 5K, and receives transfer by the action of primary transfer rollers 6Y, 6M, 6C and 6K for respective colors.

A voltage (positive polarity) applied to the primary transfer rollers 6Y–6K during transfer is controlled by the CPU in conformity with the kind of the transfer material, i.e., in conformity with the peripheral speed of the intermediate transfer member 12.

Transfer materials 2 are contained in a feed cassette 1 or a feed tray 3 as containing means (a feed port), and a transfer material 2 is conveyed on a conveying path 30 comprised of a feed roller 27 and a conveying roller 28 and arrives at a pair of registration rollers 26 as conveying means. The arrival of the transfer material is detected by a sensor 19.

During image formation, the conveyance of the transfer material is stopped for a predetermined time in timed relationship with the arrival of the color visible images on the intermediate transfer member 12 at a transfer area by a registration sensor 25. The transfer material 2 is fed to the transfer area at a predetermined conveying speed by the registration rollers 26, and a secondary transfer roller 9 contacts with the intermediate transfer member 12 and conveys the transfer material 2 while nipping the transfer material therebetween, whereby the color visible images on the intermediate transfer member 12 are transferred to the transfer material 2 at a time in superposed relationship with one another.

The conveying speed of the transfer material by the pair of registration rollers 26 is controlled by the CPU in conformity with the kind of the transfer material.

Also, a voltage (positive polarity) applied to the secondary transfer roller 9 during transfer is controlled by the CPU in conformity with the kind of the transfer material.

The secondary transfer roller 9 is in contact with the intermediate transfer member 12 as indicated by a solid line while the color visible images are transferred onto the intermediate transfer member 12 in superposed relationship with one another, but is spaced apart from the intermediate transfer member into a position indicated by a dotted line when the image transfer is completed.

The fixing portion 13 serves to fix the transferred color visible images while conveying the transfer material 2, and as shown in FIG. 1, it is provided with a fixing roller 14 for heating the transfer material 2 and a pressure roller 15 for bringing the transfer material 2 into pressure contact with the fixing roller 14. The fixing roller 14 and the pressure roller 15 are formed into a hollow shape and contain heaters 16 and 17, respectively, therein. That is, the transfer material 2 holding the color visible images thereon is conveyed by the fixing roller 14 and the pressure roller 15, and the toner thereon is fixed on the surface thereof by heat and pressure being applied thereto.

In the present embodiment, heat capacity differs in conformity with the kind of the transfer material and therefore, in order to obtain good fixing irrespective of the kind of the transfer material, the fixing speed (the peripheral speed of the rollers 14 and 15) is changed in conformity with the kind of the transfer material by the CPU. In order to synchronize with it, the peripheral speed of each photosensitive drum, the peripheral speed of each developing sleeve, the peripheral speed of the intermediate transfer belt and the conveying speed of the transfer material by the pair of registration rollers are also controlled in conformity with the kind of the transfer material by the CPU.

Specifically, when the transfer material is plain paper, the peripheral speed of each photosensitive drum, the peripheral speed of the intermediate transfer belt and the fixing speed are about 100 mm/s, and when the transfer material is OHT, the peripheral speed of each photosensitive drum, the peripheral speed of the intermediate transfer belt and the fixing speed are about 35 mm/s, and when the transfer material is thick paper (having a thickness within a predetermined range), the peripheral speed of each photosensitive drum, the peripheral speed of the intermediate transfer belt and the fixing speed are set to about 50 mm/s. As a matter of course, the peripheral speed of the secondary transfer roller, the conveying speed of the transfer material by the pair of registration rollers and the peripheral speed of each developing sleeve are also set to speeds similar to what has been described above.

The above-mentioned speeds of the respective members need not completely coincide with one another, and in the primary transfer portion, the peripheral speed of the intermediate transfer belt may be made somewhat higher than the peripheral speed of each photosensitive drum. Likewise, in the secondary transfer portion, the conveying speed of the transfer material (the peripheral speed of the secondary transfer roller) may be made somewhat higher than the peripheral speed of the intermediate transfer belt. By such a construction, a phenomenon called "hollow characters" in which a part of the transferred toner image is blanked can be prevented.

Also, the conveying speed of the transfer material by the pair of registration rollers 26 may be made somewhat higher than the conveying speed of the transfer material in the secondary transfer portion and further, the conveying speed of the transfer material by the pair of fixing rollers may be made somewhat lower than the conveying speed of the transfer material in the secondary transfer portion. Thereby, bad secondary transfer can be prevented.

As described above, the speeds of the respective members are set in conformity with the kind of the transfer material by the CPU and therefore, as described above, the voltage applied to the primary chargers, the voltage applied to the developing sleeves, the exposure speed by the scanner, and the voltages applied to the primary transfer roller and the secondary transfer roller can be controlled by the CPU and good image forming conditions can be set.

The distance from the secondary transfer portion to the fixing portion is shorter than a transfer material of the smallest usable size, and by setting the speeds of the respective members as described above, the disturbance of the unfixed toner image on the transfer material can be prevented.

The transfer material 2 after the fixing of the visible image thereon is discharged to a discharge portion, not shown, by a discharge roller, not shown, whereupon the image forming operation is terminated. The discharge of the transfer material 2 from the fixing portion 13 is detected by a fixing discharge sensor 20.

Cleaning means 21 serves to remove the toners remaining on the intermediate transfer member 12. The toners residual on the photosensitive drums 5Y, 5M, 5C and 5K are transferred to the intermediate transfer member and removed by the cleaning means 21. Waste toners are stored in a cleaner container 21*a*.

Figure 2:
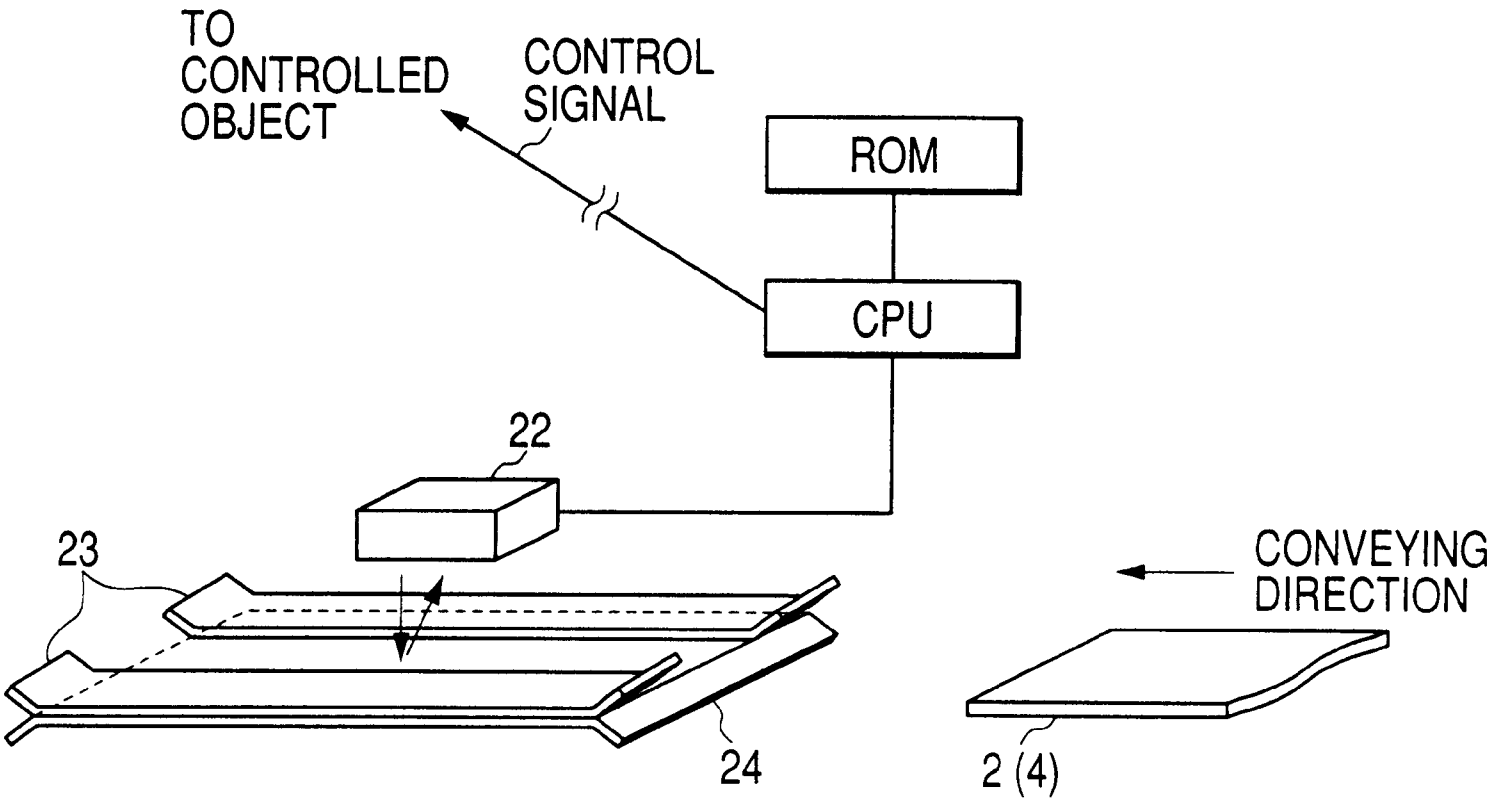
FIG. 2 shows a construction of a guide in a transfer material conveying path in the first embodiment.

In the present embodiment, a media detecting sensor 22 as detecting means is disposed in the conveying path of the transfer material 2, and below the media detecting sensor 22, as shown in detail in FIG. 2, upper and lower guides 23 and 24 are disposed so as to sandwich the transfer material 2 therebetween in order to suppress the fluttering of the transfer material 2 being conveyed.

The media detecting sensor 22 in the present embodiment is a sensor (hereinafter also referred to as the "displacement sensor") for detecting the thickness of the transfer material 2 before conveyed to the transfer area, and detects the thickness of the transfer material 2 during the printing operation, and reflects the result of the detection in the image forming conditions as described above. The method will now be described.

The displacement sensor 22 measures the distance to the lower guide 24 in a state in which the transfer material 2 is absent between the upper and lower guides 23 and 24, and measures the distance to the transfer material 2 when the transfer material 2 is present between the upper and lower guides 23 and 24.

The displacement sensor 22 is an optical type reflection type displacement sensor having a light-emitting portion and a light-receiving portion.

Figure 3:
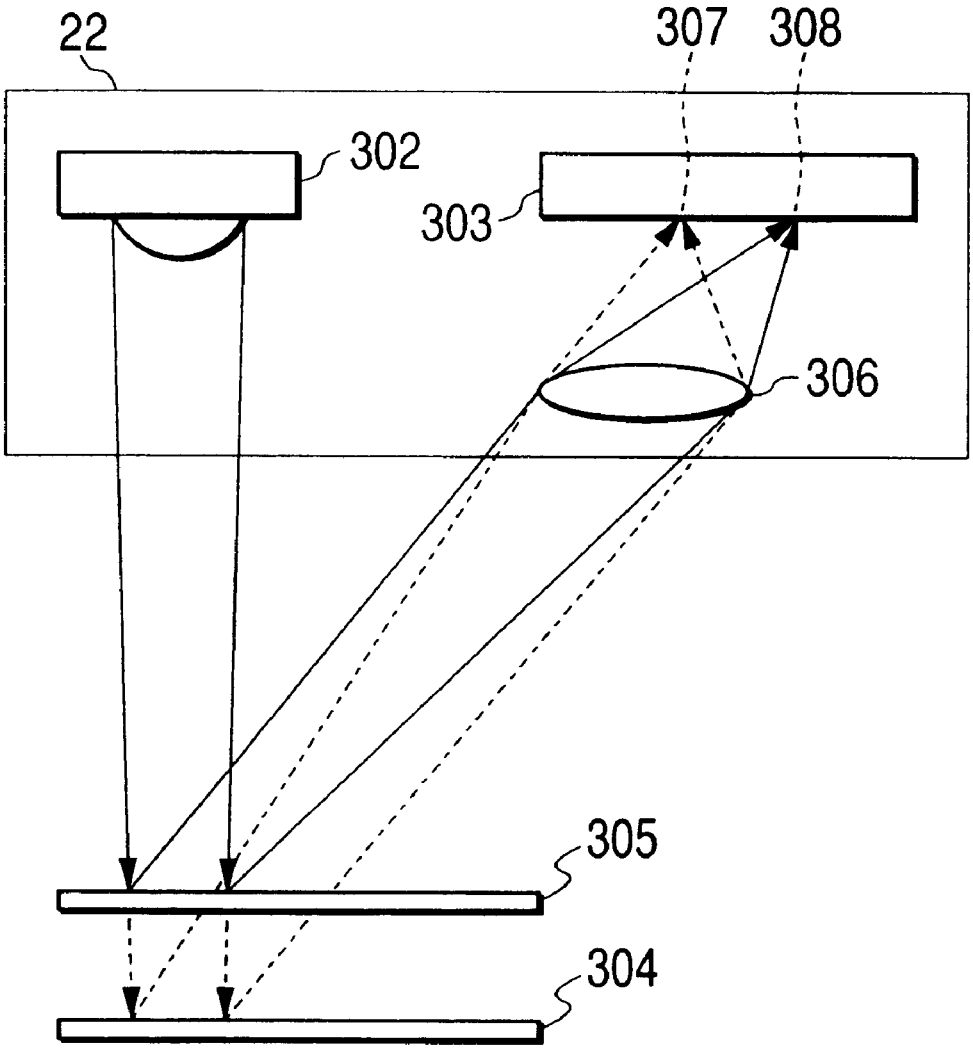
FIG. 3 is an illustration showing a displacement sensor in the first embodiment.

The optical type reflection type displacement sensor 22, as shown in FIG. 3, is provided with an LED 302 as a light-emitting element, and a position detecting element (hereinafter referred to as the "PSD") 303 which is a light-receiving element. The light-emitting element 302 applies light to detection areas 304 and 305, and detects the reflected light from the detection areas 304 and 305 by the PSD 303 through a lens 306. By the lens 306, the reflected light from an object to be measured is condensed on the PSD 303, and the focus position of the condensed reflected light changes correspondingly to the distance to the object to be measured.

Further describing, when the light applied from the light-emitting element 302 is reflected by the detection area 304, it arrives at the lens 306 as indicated by dotted line and further, is condensed at the left focus position 307 of the PSD 303 as viewed in FIG. 3 through this lens 306. On the other hand, when the light applied from the light-emitting element 302 is reflected by the detection area 305, it arrives at the lens 306 as indicated by solid line and further, is condensed at the right focus position 308 of the PSD 303 as viewed in FIG. 3 through this lens 306.

Accordingly, by processing the output signal from the PSD 303, it becomes possible to detect the distance to the object to be measured.

Figure 4:
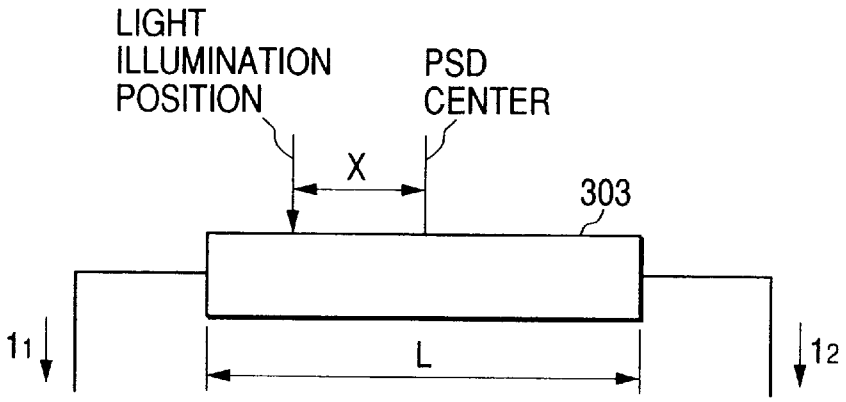
FIG. 4 is an illustration of a PSD used in the displacement sensor of FIG. 3.

FIG. 4 shows the relation between the output signal from the PSD 303 and the position information thereof.

When the outputs from the PSD 303 are defined as $\mathbf{1}_1$ and $\mathbf{1}_2$ and the full length of the PSD 303 is defined as L and the distance from the center of the PSD 303 to the focus of the reflected light is defined as X, the following expression is established:

$$(1_1-1_2)/(1_1+1_2)=2\,X/L$$

Figure 5:
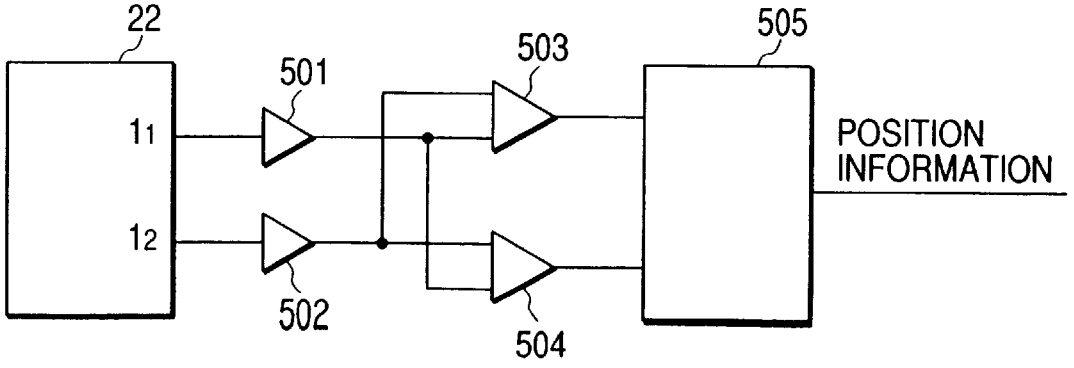
FIG. 5 is a block diagram of an electronic circuit for detecting position information from an output of the displacement sensor of FIG. 3.

This expression can be represented by a block diagram of an electronic circuit as shown in FIG. 5. That is, the outputs $\mathbf{1}_1$ and $\mathbf{1}_2$ are processed by way of current-voltage converting circuits 501 and 502, a subtraction circuit 503, an addition circuit 504 and a division circuit 505, whereby position information is obtained.

Another example for detecting the thickness of the transfer material may be of the following construction.

A pair of rollers are installed in the conveying path of the transfer material, and with the transfer material nipped between the pair of rollers, a predetermined voltage (current) is applied to one of the rollers and a current (produced voltage) flowing to the other roller is measured. This detected current is related to the resistance value of the transfer material and therefore, the thickness of the transfer material related to this resistance value can be known. Further, if during the detection, the thickness of the transfer material is judged on the basis of the temperature and humidity in the apparatus, the accuracy of detection will of course heighten.

Figure 6:
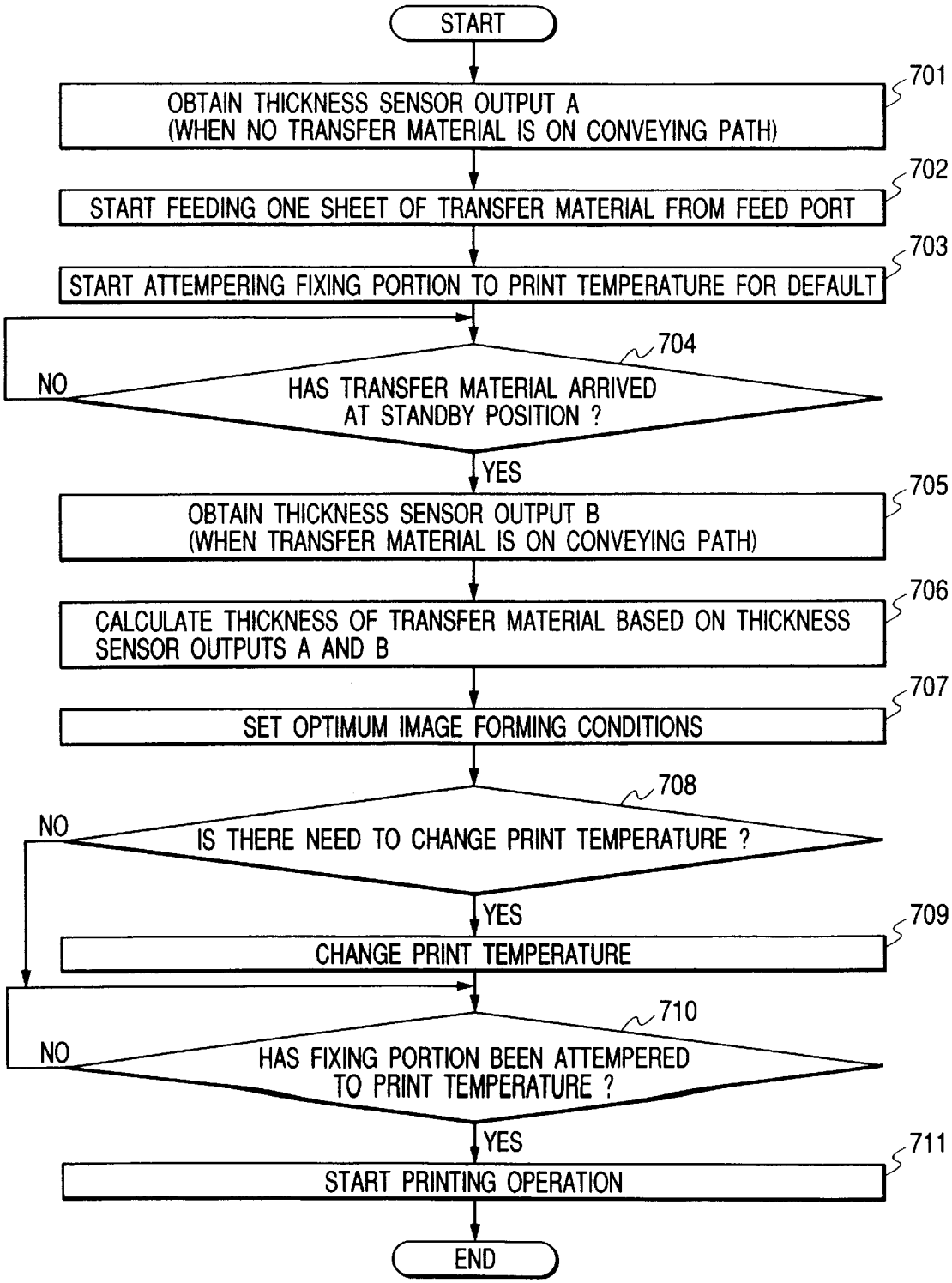
FIG. 6 is a flowchart of a printing operation in the first embodiment and a second embodiment.

Reference is now had to FIG. 6 to describe a method of detecting the thickness of the transfer material in the present embodiment and determining optimum image forming conditions, and reflecting them in the printing operation.

When instructions for printing are transmitted, the output A of the displacement sensor 22 is first obtained with no transfer material in the conveying path (701). The sensor output A at this time indicates the distance to the guide 24. After the output A of the displacement sensor 22 has been obtained, a feeding of a transfer material is started from a designated feed port (702), and the attempering of the fixing portion to the print temperature for default is started (703). After the conveyance of the fed transfer material 2 to the standby position of the registration rollers has been detected (704), or after the conveyance of the transfer material 2 to the position of the displacement sensor 22 has been detected (704), the output B of the displacement sensor 22 with the transfer material sandwiched between the upper and lower guides 23 and 24 is obtained (705), and is compared with the output A of the displacement sensor when there is no transfer material on the conveying path, thereby calculating the thickness of the transfer material 2 (706). Optimum image forming conditions are set in conformity with the calculated thickness of the transfer material 2 (707). From the thickness information of the transfer material 2 at this time, whether it is necessary to change the print temperature is judged (708), and if it is necessary, the print temperature is also changed (709). After the fixing portion 13 has reached the print temperature (710), the printing operation is performed under the optimum image forming conditions (711).

As described above, it becomes possible to detect the thickness of the transfer material by the displacement sensor, and perform the printing operation under the optimum image forming conditions conforming to the thickness of the transfer material to thereby obtain an image of high quality. Further, after the feeding of the transfer material has been started at the start of the printing operation, the temperature of the fixing portion 13 starts to be attempered to the print temperature for default (the temperature for fixing the toner image on plain paper (transfer paper of which the basic weight is 100 g/cm$^2$ or less) thinner than thick paper) and therefore, the first print time, i.e., the time from after an image formation starting signal is inputted to the image forming apparatus (inputted from a computer to an interface through a cable or inputted from the touch panel or the like of the apparatus) until the transfer material is discharged is equal to that in the print control according to the conventional art.

Figures 7, 7A:
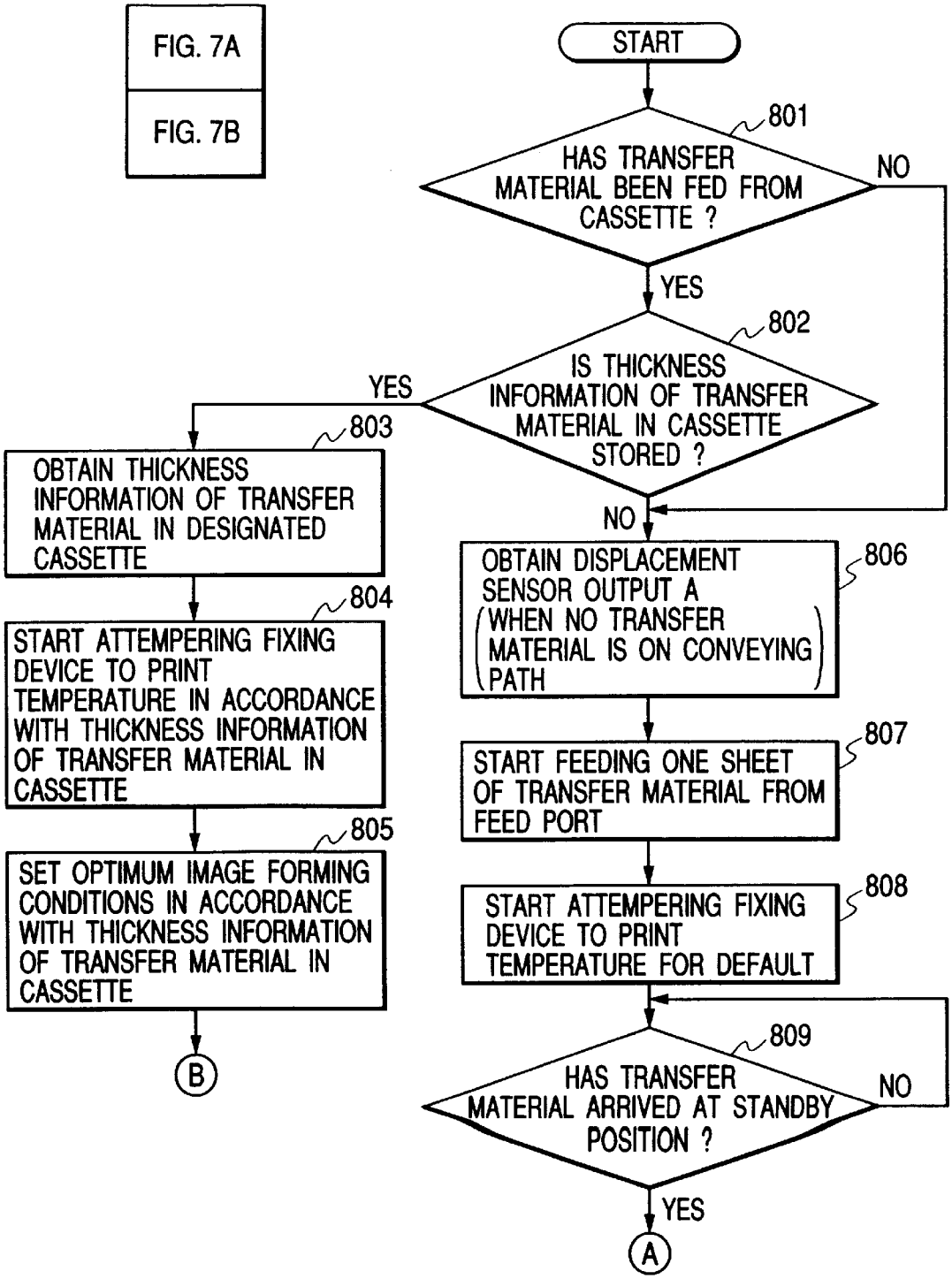
FIG. 7 is comprised of FIG. 7A and FIG. 7B showing flowcharts of the printing operation in the first embodiment.
Figure 7B:
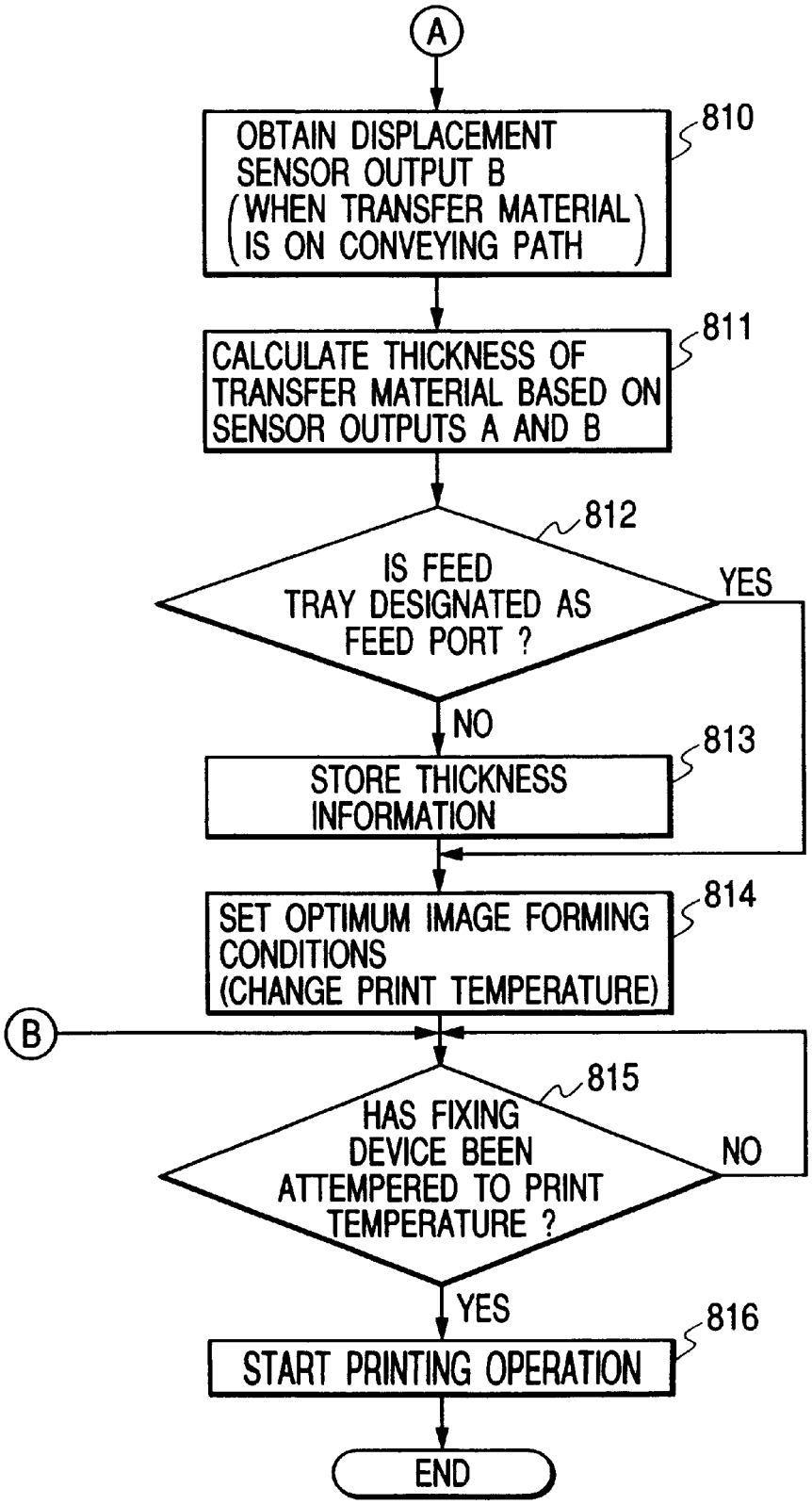

Description will now be made with reference to FIG. 7A and FIG. 7B.

In the present embodiment, the thickness of the first sheet of transfer material is detected during the printing operation, and the result of the detection is reflected in the above-described image forming conditions, and the thickness information of this first sheet of transfer material is stored in a ROM as memory means, and after the thickness information has once been obtained, the thickness information of the transfer material is detected again only when there is the possibility of the thickness of the transfer material being changed.

The time from after a latent image has started to be formed on the photosensitive drum 5Y until a toner image corresponding to the latent image is transferred to the intermediate transfer member 12 and arrives at the transfer area to the transfer member is longer than the time from after the transfer material has been detected by the media detecting sensor 22 until the transfer material arrives at the transfer area from the feed cassette 1 or the feed tray 3 by the feed roller 27, the conveying roller 28 and the registration rollers 26 as conveying means.

Also, when images are to be continuously formed on a plurality of transfer materials, the time interval at which the plurality of transfer materials are conveyed to the transfer area by the conveying means is shorter than the time from after a latent image has started to be formed on the photosensitive drum 5Y until a toner image corresponding to the latent image is transferred to the intermediate transfer member 12 and arrives at the transfer area. By such a construction, the throughput when images are continuously formed on a plurality of transfer materials can be improved.

Accordingly, when images are to be continuously formed on a plurality of transfer materials, if each transfer material is detected by the media detecting sensor 22 before the formation of a latent image on the photosensitive drum 5Y, the throughput is reduced and therefore, in the present invention, when there is the possibility that the transfer material contained or placed in the feed cassette 1 or the feed tray 3 has been changed, or after the closing of the power source switch of the main body of the apparatus (not when a power supply cable is connected to an outlet to which the power source has come, but after a power source switch provided in the main body of the apparatus has been closed), only the transfer material on which an image is first formed is detected by the media detecting sensor 22, and the subsequent transfer materials are not detected by the media detecting sensor 22 for the improvement in the throughput of image formation (or if detected, it is not in time for the formation of a latent image and therefore the information is not fed back). Such control is repeated each time there is the possibility of the kind of the transfer material having been changed.

After the power source switch of the main body of the apparatus has been closed as described above, the first transfer material is detected by the media detecting sensor 22, and thereafter the feed cassette 1 (which is provided with a convex portion capable of being pushed into the main body of the apparatus, and when the feed cassette 1 is mounted, this convex portion is pushed in so that it can be known that the mounting or dismounting operation has been performed, and information as to whether the mounting or dismounting operation has been performed is sent to the CPU as control means) is detached from the main body of the apparatus, and is replenished with transfer materials and is mounted to the main body of the apparatus, whereafter a transfer material on which an image is to be first formed is detected by the media detecting sensor 22. Such control is repeated each time the mounting or dismounting of the feed cassette 1 is effected, and when a plurality of feed cassettes 1 are provided, the control is effected for each feed cassette.

Also, in the case of the feed tray 3, there is no special construction for judging whether the user has added further transfer materials to the transfer materials already placed on the feed tray 3 and therefore, also when the feed tray 3 is selected by the user and images are to be continuously formed on a plurality of transfer materials, the first transfer material is detected by the media detecting sensor 22 and the subsequent transfer materials are not detected. In this case, such control is effected in each sequence wherein the feed tray 3 is selected and images are continuously formed on a plurality of transfer materials.

As described above, only the first transfer material is detected by the media detecting sensor 22 and therefore, any reduction in the throughput of image formation on the subsequent transfer materials can be prevented.

The present embodiment has a memory (ROM) as memory means for storing therein the thickness information of the transfer material in each feed port. This memory is designed to clear the thickness information of the transfer material in every feed port during the closing of the power source switch, and when a detachably mountable feed port (hereinafter referred to as the "feed cassette") 1 is opened or closed, to clear the thickness information of the transfer material 2 in the opened or closed feed cassette 1 on the assumption that there is the possibility of the feed cassette having been replenished with a different kind of transfer materials. However, when transfer materials are supplied after the closing of the power source switch, the thickness information of the transfer materials 2 in the feed port, i.e., the feed tray (manual feed port) 3 free of any special operation such as the mounting or dismounting of the feed cassette 1 is not stored.

Also, when a plurality of feed cassettes are provided, the memory is designed to store therein the information of the kind (thickness) of the transfer materials in each feed cassette.

The printing operation in the present embodiment will now be described with reference to the flowcharts of FIG. 7A and FIG. 7B.

When a printing command is transmitted, the set feed port is examined (801). When the set feed port is the feed cassette 1, whether the thickness information of the transfer material in the designated feed cassette 1 is stored in the memory is judged (802), and if the thickness information is stored in the memory, that is, if the thickness of the transfer material in the feed cassette designated this time has been detected before and thereafter the opening or closing (mounting or dismounting) of the feed cassette 1 is not effected, the thickness information of the transfer material in the designated feed cassette 1 is obtained from the memory (803), and the attempering of the fixing device to a print temperature conforming to that thickness information is started (804), and optimum image forming conditions conforming to the thickness information are set (805). After the print temperature has been reached (815), image formation is started (816).

Also, if at the step 801, the feed port is the feed cassette 1 and the thickness information of the transfer material in the set feed cassette 1 is not stored in the memory (802), that is, if the opening or closing of the feed cassette 1 designated for the first time after the power source switch has been closed, or the opening or closing of the designated feed cassette 1 is effected, the thickness of the transfer material 2 retained in the designated feed cassette 1 is detected. First, the output A of the displacement sensor is obtained with no transfer material on the conveying path 30 of the transfer material 2 (806), and the feeding of the transfer material is started from the designated feed cassette 1 (807), and the attempering of the fixing device to the print temperature for default (plain paper mode) is started (808). When the fed transfer material arrives at the standby position of the registration rollers 26, the conveyance of the transfer material is stopped (809), and the output B of the displacement sensor is obtained with the transfer material present on the conveying path 30 (810), and is compared with the output A of the displacement sensor when there is no transfer material on the already obtained conveying path 30, whereby the thickness of the transfer material is obtained (811). Here, it is judged that the designated feed port is not the feed tray (812), and then the thickness information of this transfer material is stored in the memory (813), whereafter optimum image forming conditions conforming to the thickness information of this transfer material are set (814). When at this time, the print temperature of the fixing device conforming to the thickness information of the transfer material and the print temperature being already attempered differ from each other, the temperature setting is changed. After the print temperature has been reached (815), the printing operation is started (816).

If the feed port designated when the printing command has been transmitted is the feed tray 3 (801), the thickness of the transfer material is detected each time printing is started. The control thereof is similar to that when the thickness information of the transfer material in the above-described feed cassette 1 is calculated (806–811), but the thickness information of the transfer material in the feed tray 3 is not stored in the memory, and as described above, the optimum image forming conditions are set (814), and after the print temperature has been reached (815), the printing operation is started (816). This is a case where image formation is intermittently effected on each sheet of transfer material. When for example, ten sheets of transfer materials are placed on the feed tray 3 and image formation is to be continuously effected on these ten sheets of transfer materials, thickness detection is effected for only the first transfer material, and for the second to tenth transfer materials, thickness detection is not effected but image formation is effected.

As described above, the thickness information of the transfer material is stored and after the thickness information has once been obtained, it is made effective until there is the possibility of the thickness of the transfer material being changed, whereby the frequency of the detection of the thickness of the transfer material can be reduced, and an improvement in the throughput of image formation becomes possible. Also, as described above, the detection of the kind of the second and subsequent transfer materials is not effected by the sensor and therefore, the power consumption of the sensor can be reduced and control can be effected easily.

Embodiment 2

A second embodiment of the present invention will now be described with reference to FIGS. 8 and 9.

While in the first embodiment, the upper and lower guides are provided in the conveying path of the transfer material and the thickness of the transfer material is calculated from the outputs of the displacement sensor when the transfer material is present between the upper and lower guides and when the transfer material is absent between the upper and lower guides, in the present embodiment, the displacement of a conveying roller which is a rotary member for conveying the transfer material is detected by a displacement sensor to thereby detect the thickness of the transfer material. In the other points, the construction of the present embodiment is similar to that of Embodiment 1.

Figure 8:
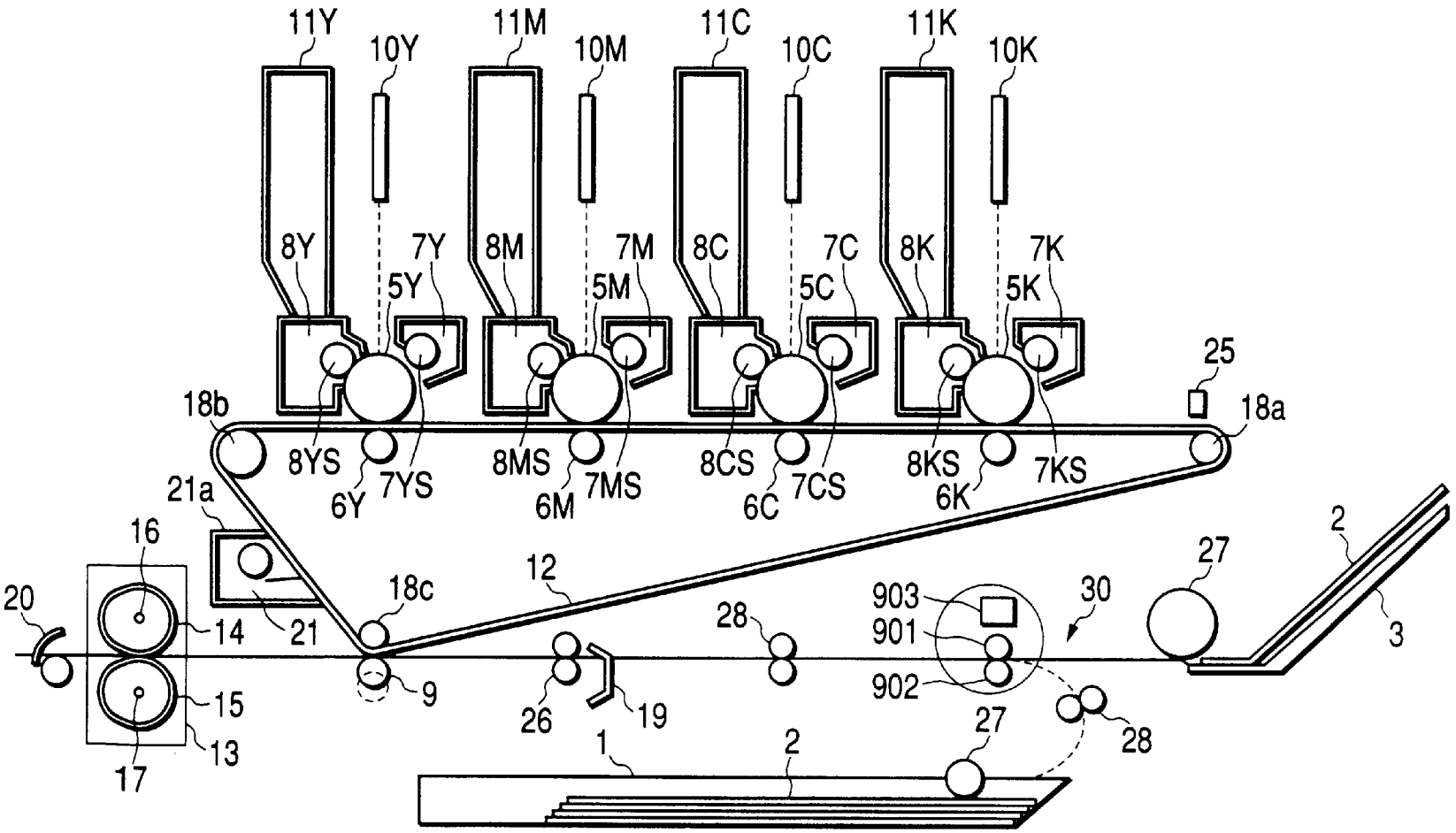
FIG. 8 shows a general construction of an image forming apparatus according to the second embodiment.

As shown in FIG. 8, an upper conveying roller 901 and a lower conveying roller 902 are provided on the conveying path 30 for the transfer material, and a displacement sensor 903 is disposed above the upper conveying roller 901. The transfer material 2 is conveyed while being nipped between the upper and lower conveying rollers 901 and 902. At this time, the upper conveying roller 901 is vertically moved by the thickness of the transfer material 2. In the present embodiment, the vertical movement of the upper conveying roller 901 is detected by the displacement sensor 903 to thereby detect the thickness of the transfer material 2. That is, the lower roller 902 is fixed and is not vertically moved.

Figure 9:
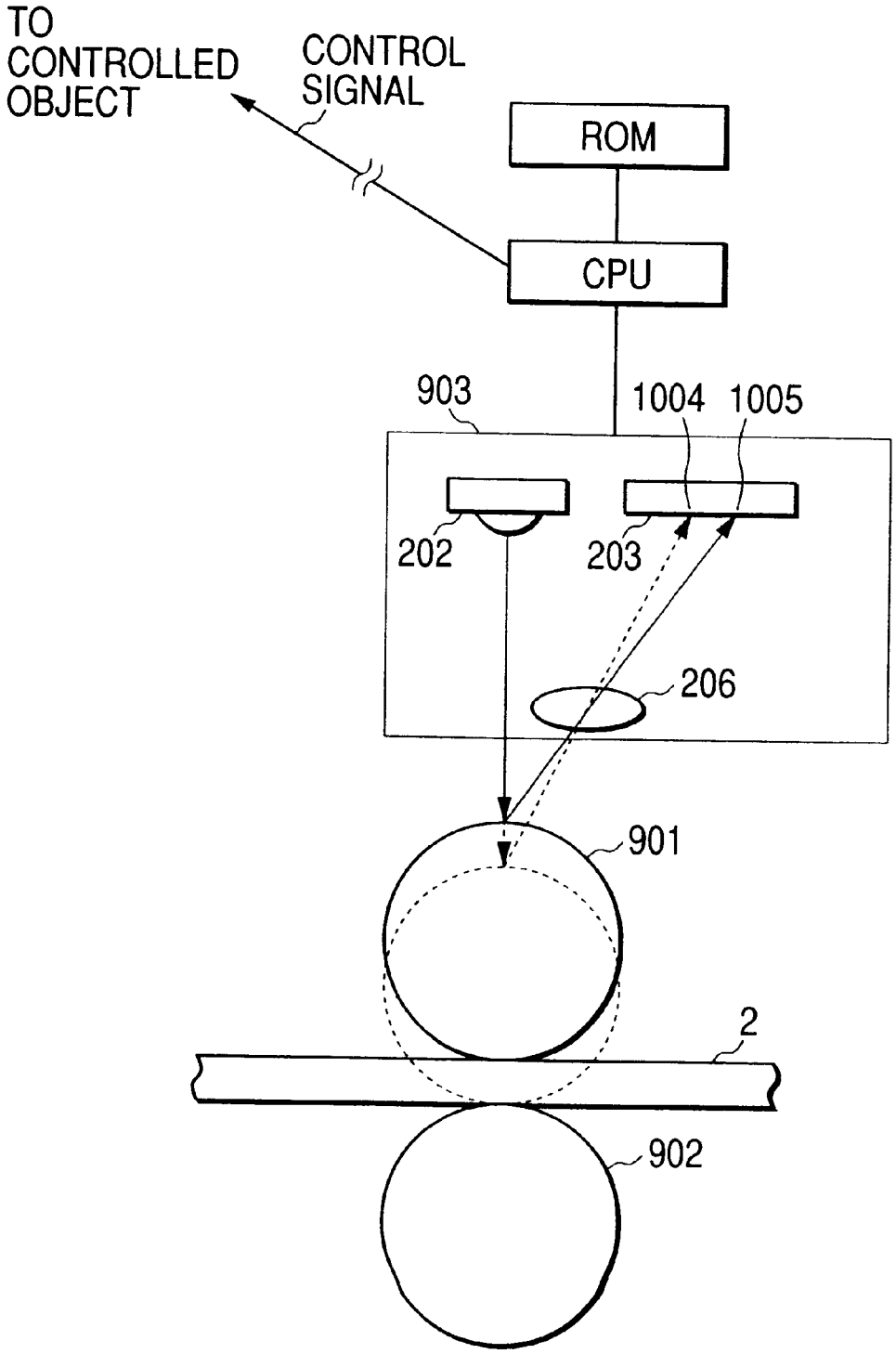
FIG. 9 shows a construction of a thickness detecting portion for a transfer material in the second embodiment.

FIG. 9 shows the constructions of the displacement sensor 903 and the upper and lower conveying rollers 901 and 902 in the present embodiment.

In FIG. 9, the upper conveying roller 901 indicated by dotted line is that when the transfer material is absent, and the upper conveying roller 901 indicated by solid line is that when the transfer material is present.

The displacement sensor 903 is provided with an LED 202 as a light emitting element, a position detecting element (PSD) 203 and a lens 206.

In this displacement sensor 903, the output 1004 thereof is obtained when the transfer material is absent between the upper and lower conveying rollers 901 and 902 before the delivery of the printing command or immediately after the start of the printing operation. Next, when the transfer material is nipped between the upper and lower conveying rollers 901 and 902, the output 1005 of the displacement sensor 903 is obtained. As described in the first embodiment, the thickness of the transfer material can be detected by these sensor outputs 1004 and 1005.

A flowchart for detecting the thickness of the transfer material during the printing operation in the present embodiment, and determining optimum image forming conditions conforming to the thickness of the transfer material is similar to that in the first embodiment.

Embodiment 3

Figure 10:
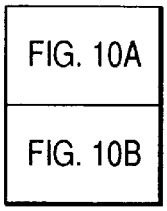
FIG. 10 is comprised of FIG. 10A and FIG. 10B showing flowcharts of a printing operation in a third embodiment.
Figure 10A:
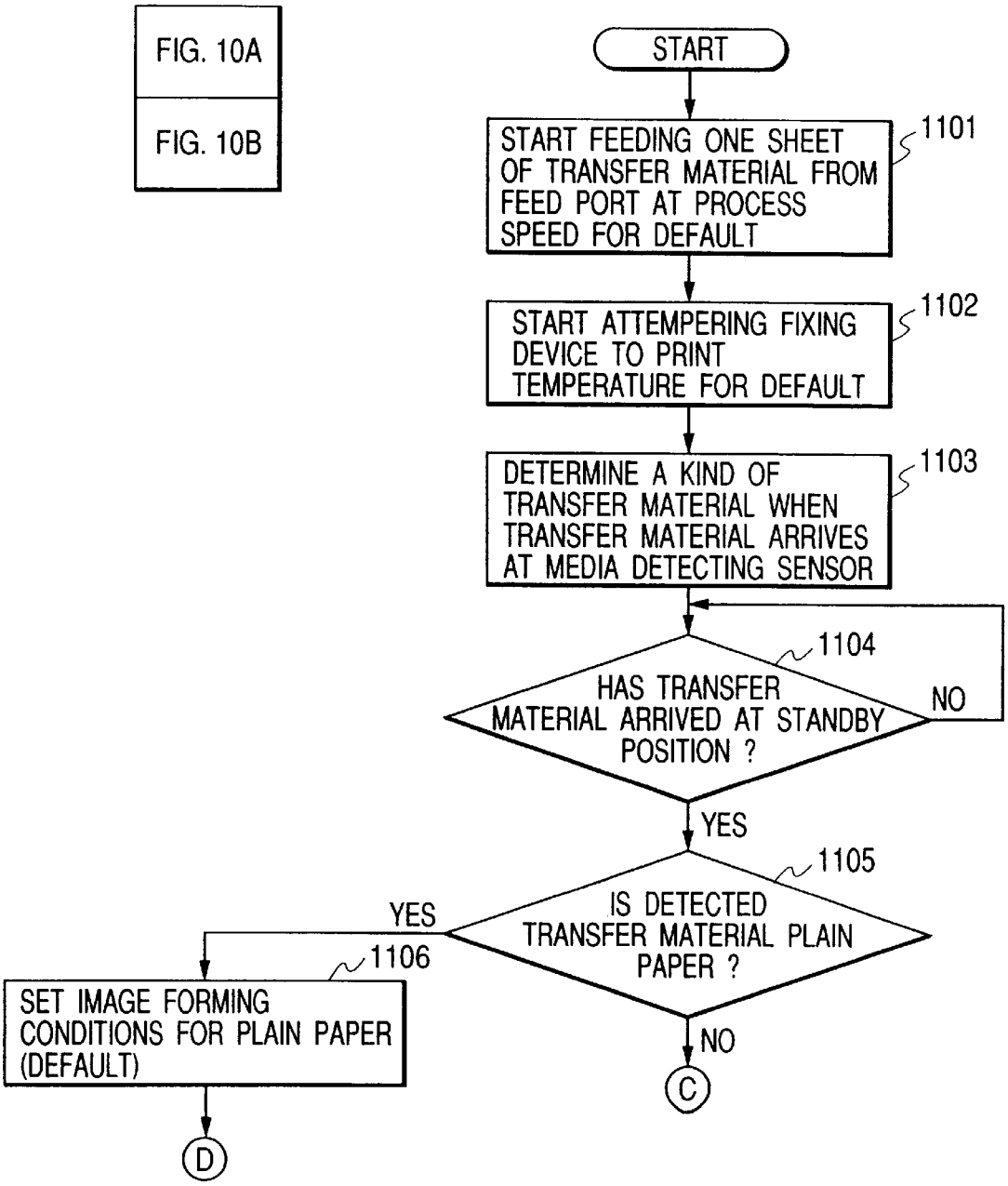
Figure 10B:
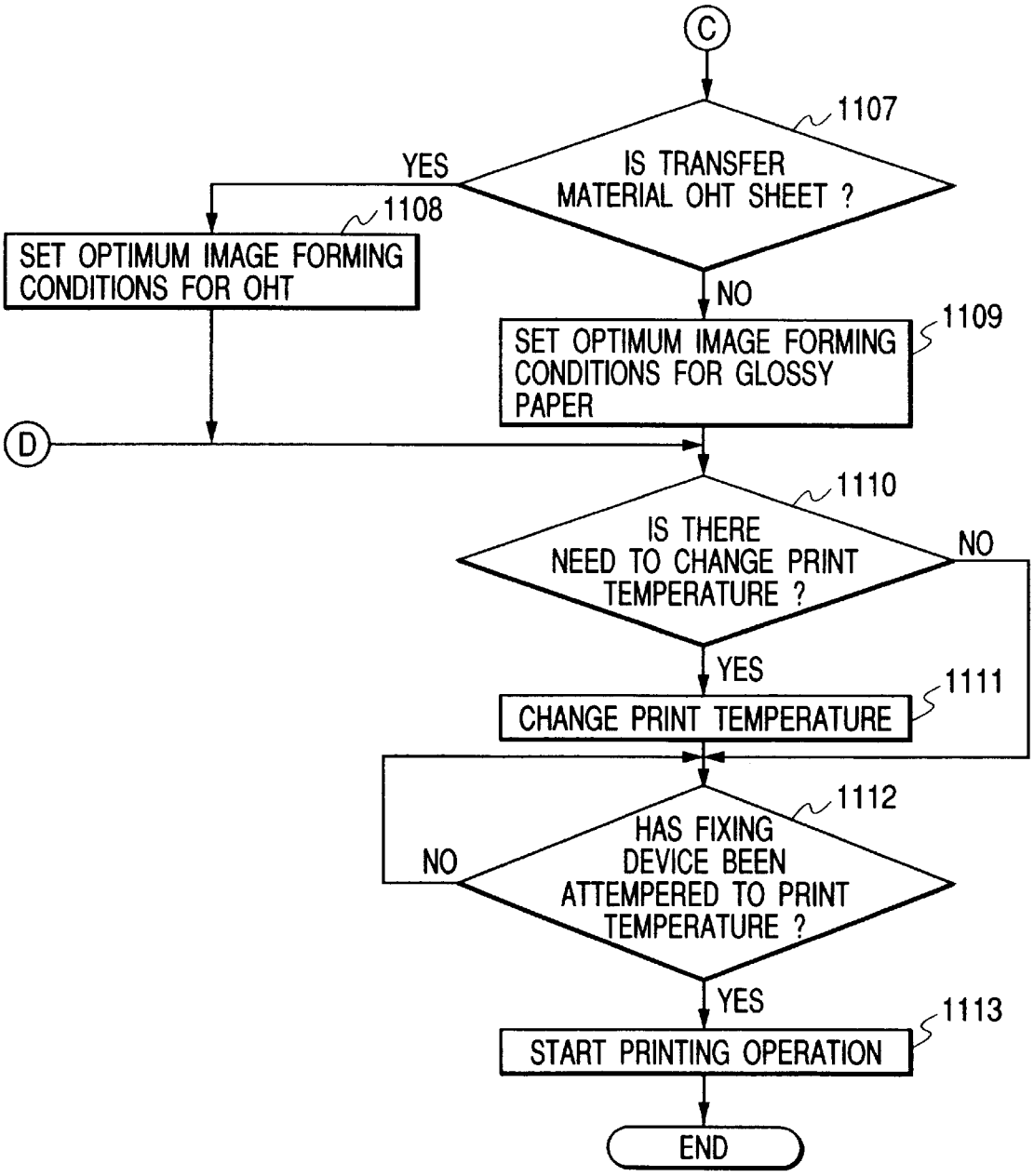

A third embodiment of the present invention will now be described with reference to FIGS. 10A and 10B.

In the above-described embodiments, the thickness of the transfer material is detected during the printing operation, and the result of the detection is reflected in the image forming conditions, and the thickness information of the transfer material is stored, and after the thickness information has once been obtained, the thickness information of the transfer material is again detected only when there is the possibility of the thickness of the transfer material being changed.

In the present embodiment, the thickness of the transfer material is not detected as in the first and second embodiments, but the kinds of the transfer material such as OHT paper (light-transmissive resin sheet), glossy paper and plain paper are detected by a sensor, and during the printing operation, the result of the detection is reflected in image forming conditions.

The sensor is provided with a light-emitting element and two light-receiving elements, and the two light-receiving elements are designed to detect the transmitted light and reflected light, respectively, from the light-emitting element. The kind of the transfer material is detected by the use of at least one of the transmitted light and the reflected light. This sensor provided with the light-emitting and light-receiving elements and the sensor for detecting the thickness of the transfer material as in the first and second embodiments may be combined together to thereby reflect the two pieces of information in the image forming conditions.

The printing operation in the present embodiment will now be described with reference to the flowcharts of FIG. 10A and FIG. 10B.

When a printing command is transmitted, sheet feeding is started from a designated feed port at an ordinary process speed (for plain paper) (1101), and the attempering of the fixing device to an ordinary print temperature (for plain paper) is started (1102). When the fed transfer material 2 arrives at the position of the media detecting sensor, the kind of the transfer material is determined by the media detecting sensor (1103). Thereafter, it is detected that the transfer material 2 has been conveyed to the standby position of the registration rollers 26 (1104), whereafter depending on the kind of the transfer material detected at the step 1103, optimum image forming conditions (such as a process speed and a transfer condition) are set as described in Embodiment 1.

First, whether the detected transfer material is plain paper is Judged, and if it is plain paper, image forming conditions for plain paper (default) are set (1106). If at a step 1105, the transfer material is not plain paper, whether the transfer material is OHT is judged (1107), and if it is OHT, optimum image forming conditions for OHT are set (1108). If at the step 1107, the transfer material is not OHT, optimum image forming conditions for glossy paper are set (1109).

Depending on the kind of the transfer material at this time, whether it is necessary to change the print temperature for the fixing in the fixing device is judged (1110), and if it is necessary, the print temperature is changed (1111). When the fixing portion reaches the print temperature (1112), the printing operation is performed under optimum image forming conditions (1113).

As described above, in the present embodiment, by detecting the kind of the transfer material, it becomes possible to perform the printing operation under optimum image forming conditions conforming to the kind of the transfer material.

Also, as described in the first embodiment, after the information of the kind of the transfer material has been stored and that information has once been obtained, the information is made effective until there is the possibility of the kind of the transfer material being changed, whereby the frequency of the media detection of the transfer material can be reduced, and an improvement in the throughput of image formation becomes possible.

Figure 11:
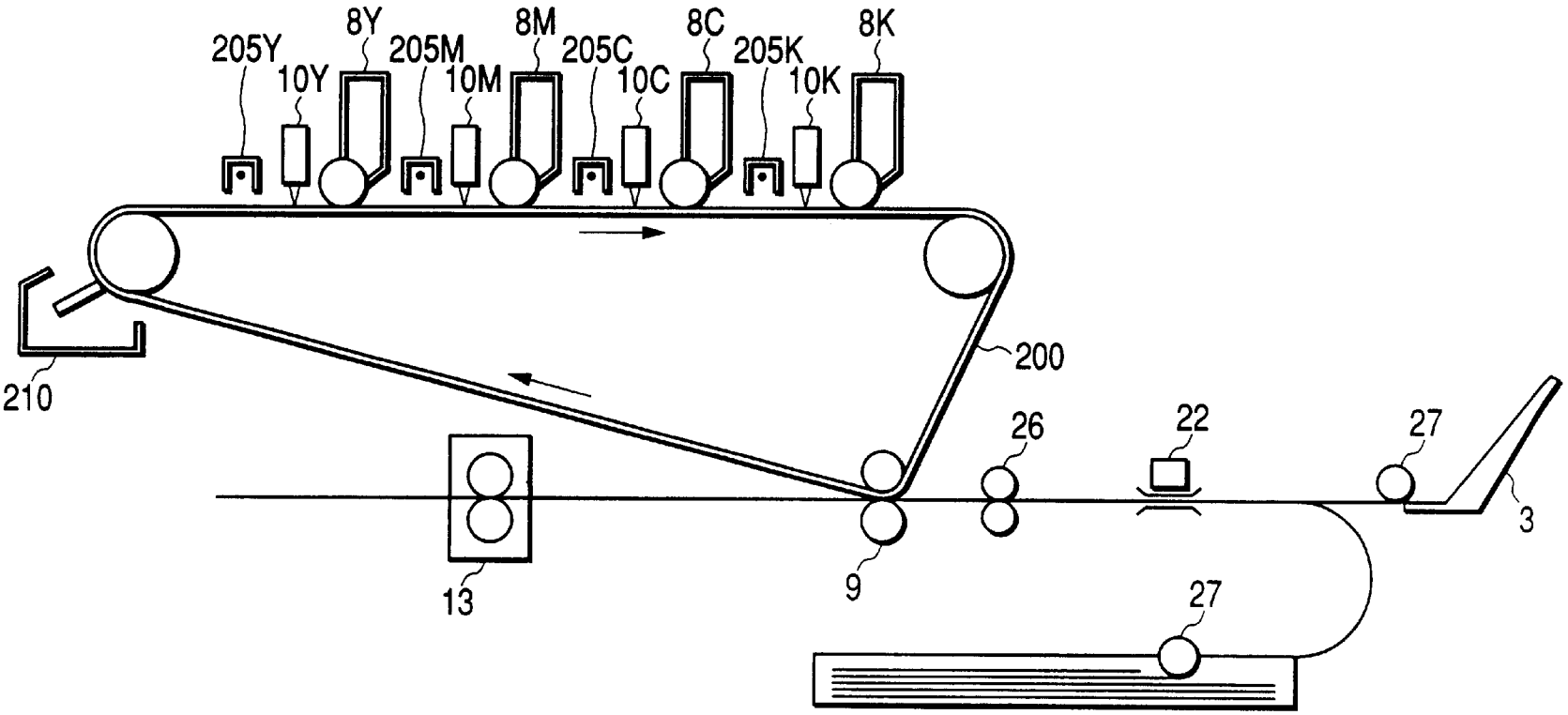
FIG. 11 shows an example of an application of the present invention.
Figure 12:
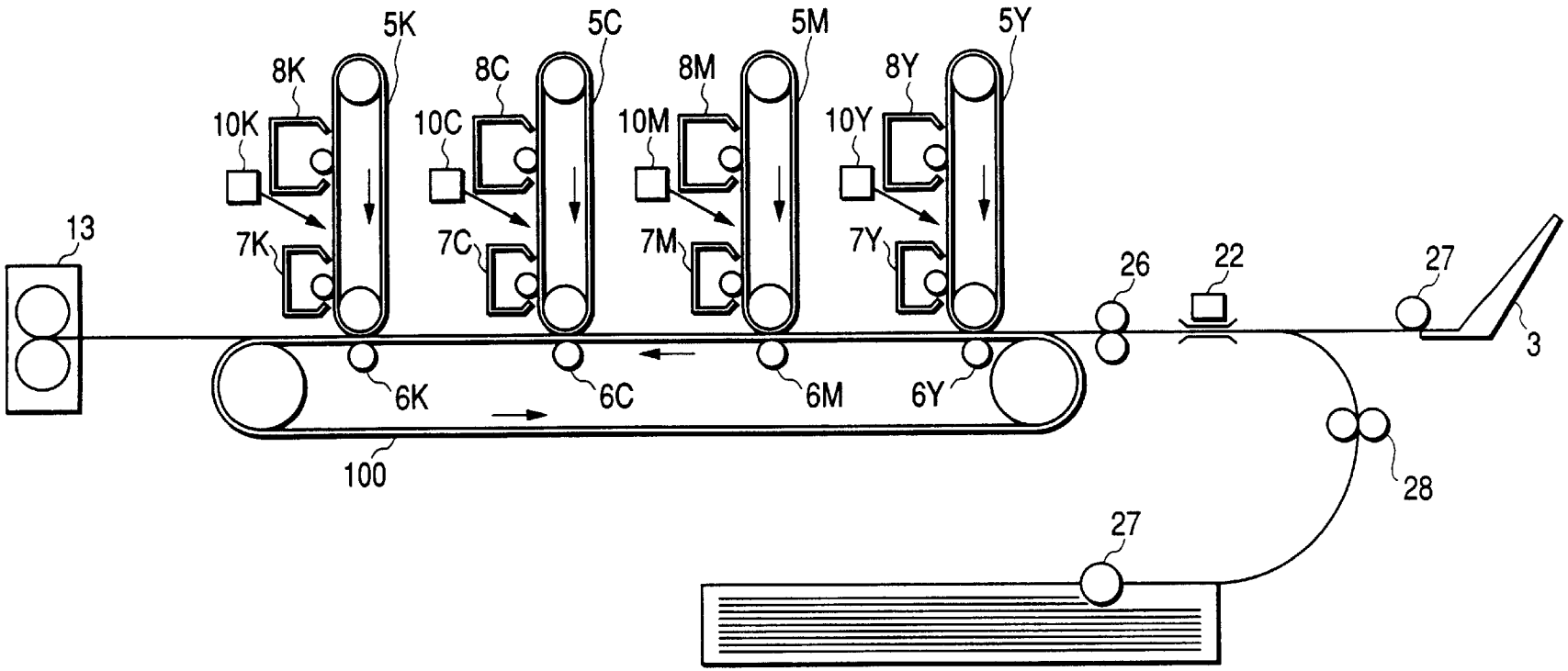
FIG. 12 shows an example of an application of the present invention.
Figure 13:
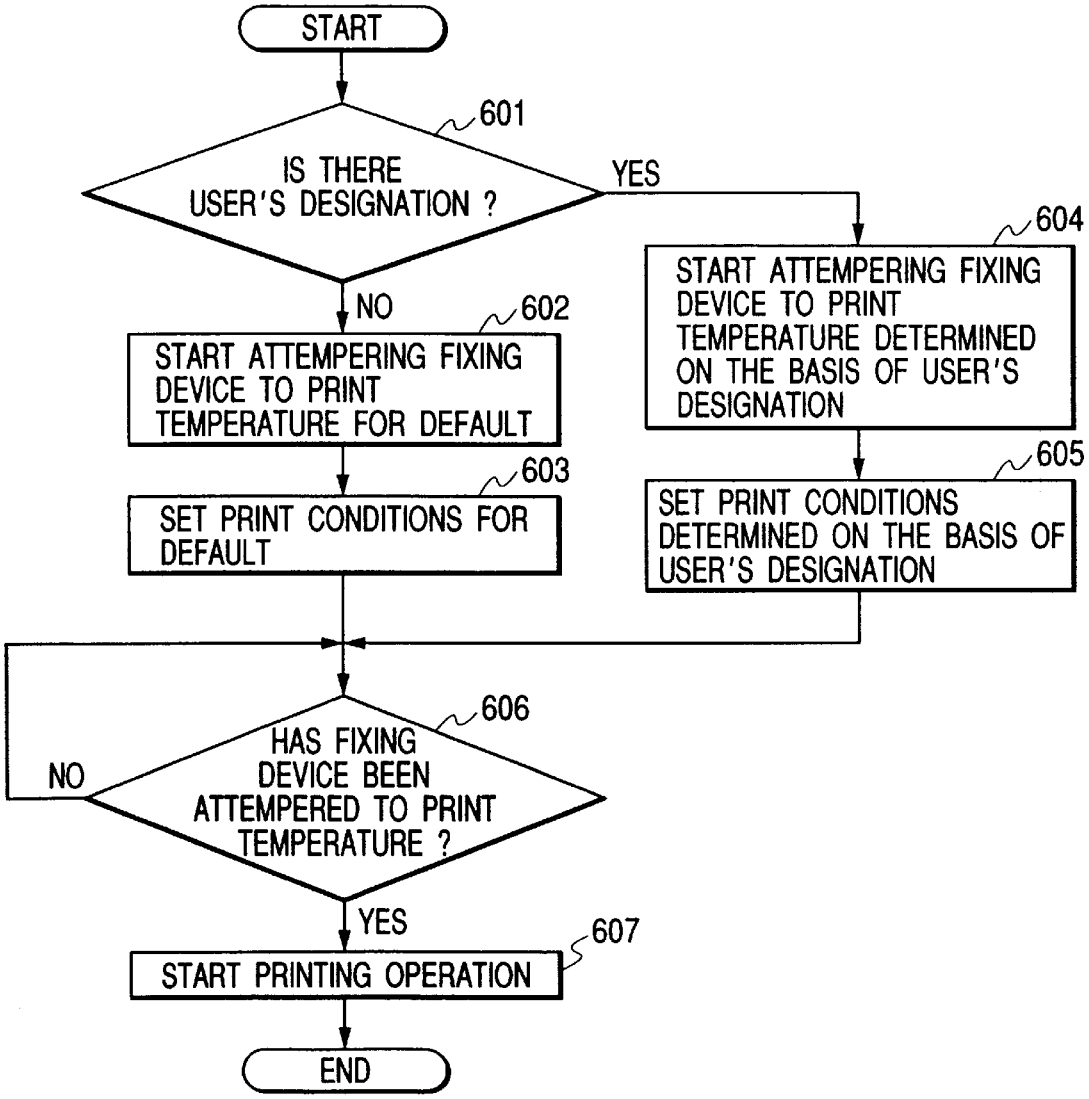
FIG. 13 is a flowchart of a printing operation in an example of the conventional art.

While the above Embodiments 1 to 3 have been described with respect to an image forming apparatus using an intermediate transfer member, the present invention is not restricted thereto. For example, the present invention is likewise applicable to a conventional image forming apparatus of a type as shown in FIG. 11 wherein toner images are sequentially superposed on top of one another on a photosensitive belt 200 to form toner images and the toner images are collectively transferred to a transfer material, or a conventional image forming apparatus of a type as shown in FIG. 12 wherein toner images formed on photosensitive belts are successively transferred to a transfer material borne on a transfer material bearing member 100 in superposed relationship with one another. In the above-described two conventional image forming apparatuses, a plurality of image forming stations are provided for respective ones of toners of plural colors in order to form a color image. In FIGS. 11 and 12, the functionally same members as those in Embodiments 1 to 3 are given the same reference characters and need not be described.

In FIG. 11, primary chargers 205Y–205K are corona chargers, and the reference numeral 210 designates a cleaning device (cleaning blade).

What is claimed is:

1. An image forming apparatus comprising:

an image bearing member;

image forming means for forming an image on said image bearing member;

an intermediate transfer member to which the image is transferred from said image bearing member, the image on said intermediate transfer member being transferred to a transfer material at a transfer position;

detecting means for detecting a kind of the transfer material;

conveying means for conveying the transfer material to said transfer position;

wherein a time period between a time when the image starts to be formed on said image bearing member by said image forming means and a time when the image on said image bearing member formed by said image forming means is transferred to said intermediate transfer member and arrives at said transfer position is longer than a time period between a time when the kind of the transfer material is detected by said detecting means and a time when the transfer material arrives at said transfer position by said conveying means; and changeover means for selectively changing over a first mode for forming the image on said image bearing member by said image forming means on a basis of the kind of the transfer material detected by said detecting means, and a second mode for forming the image on said image bearing member by said image forming means on a basis of a result of a detection by said detecting means in said first mode irrespective of whether the kind of the transfer material is detected by said detecting means or not.

2. An image forming apparatus according to claim 1, further comprising memory means for storing therein information of the kind of the transfer material detected by said detecting means in said first mode.

3. An image forming apparatus according to claim 2, wherein when said second mode is selected, the image is formed on said image bearing member by said image forming means on a basis of the information stored in said memory means.

4. An image forming apparatus according to claim 2, further comprising control means for controlling an image forming condition on the basis of the result of the detection by said detecting means.

5. An image forming apparatus according to claim 4, wherein said image forming means is provided with charging means for charging said image bearing member, and said control means controls a charging condition of said charging means on the basis of the result of the detection by said detecting means.

6. An image forming apparatus according to claim 5, wherein said image forming means is provided with exposing means for exposing said image bearing member charged by said charging means to thereby form a latent image, and said control means controls an exposing condition of said exposing means on the basis of the result of the detection by said detecting means.

7. An image forming apparatus according to claim 6, wherein said image forming means is provided with developing means for developing the latent image on said image bearing member to thereby form a toner image, and said control means controls a developing condition of said developing means on the basis of the result of the detection by said detecting means.

8. An image forming apparatus according to claim 7, wherein a time period between a time when the latent image starts to be formed on said image bearing member by said exposing means and a time when the toner image on said image bearing member formed by said developing means is transferred to said intermediate transfer member and arrives at said transfer position is longer than the time period between the time when the kind of the transfer material is detected by said detecting means and the time when the transfer material arrives at said transfer position by said conveying means.

9. An image forming apparatus according to claim 4, wherein said control means controls a peripheral speed of said image bearing member on the basis of the result of the detection by said detecting means.

10. An image forming apparatus according to claim 9, wherein said detecting means detects whether the transfer material is light-transmissive resin.

11. An image forming apparatus according to claim 10, wherein when the transfer material is light-transmissive resin, said control means changes over the peripheral speed of said image bearing member to a second peripheral speed lower than a first peripheral speed.

12. An image forming apparatus according to claim 9, wherein said detecting means detects a thickness of the transfer material.

13. An image forming apparatus according to claim 12, wherein said control means changes over the peripheral speed of said image bearing member to a second peripheral speed lower than a first peripheral speed on the basis of the result of the detection by said detecting means.

14. An image forming apparatus according to claim 4, wherein said control means controls a peripheral speed of said intermediate transfer member on the basis of the result of the detection by said detecting means.

15. An image forming apparatus according to claim 14, wherein said detecting means detects whether the transfer material is light-transmissive resin.

16. An image forming apparatus according to claim 15, wherein when the transfer material is light-transmissive resin, said control means changes over the peripheral speed of said intermediate transfer member to a second peripheral speed lower than a first peripheral speed.

17. An image forming apparatus according to claim 14, wherein said detecting means detects a thickness of the transfer material.

18. An image forming apparatus according to claim 17, wherein said control means changes over the peripheral speed of said intermediate transfer member to a second peripheral speed lower than a first peripheral speed on the basis of the result of the detection by said detecting means.

19. An image forming apparatus according to claim 4, wherein said control means controls a conveying speed of the transfer material by said conveying means on the basis of the result of the detection by said detecting means.

20. An image forming apparatus according to claim 19, wherein said detecting means detects whether the is transfer material is light-transmissive resin.

21. An image forming apparatus according to claim 20, wherein when the transfer material is light-transmissive resin, said control means changes over the conveying speed of the transfer material by said conveying means to a second conveying speed lower than a first conveying speed.

22. An image forming apparatus according to claim 19, wherein said detecting means detect s a thickness of the transfer material.

23. An image forming apparatus according to claim 22, wherein said control means changes over the conveying speed of the transfer material by said conveying means to a second conveying speed lower than a first conveying speed on the basis of the result of the detection by said detecting means.

24. An image forming apparatus according to claim 4, further comprising fixing means for fixing the image on the transfer material, and wherein said control means controls a fixing speed of said fixing means on the basis of the result of the detection by said detecting means.

25. An image forming apparatus according to claim 24, wherein said detecting means detects whether the transfer material is light-transmissive resin.

26. An image forming apparatus according to claim 25, wherein when the transfer material is light-transmissive resin, said control means changes over the fixing speed of said fixing means to a second fixing speed lower than a first fixing speed.

27. An image forming apparatus according to claim 24, wherein said detecting means detects a thickness of the transfer material.

28. An image forming apparatus according to claim 27, wherein said control means changes over the fixing speed of said fixing means to a second fixing speed lower than a first fixing speed on the basis of the result of the detection by said detecting means.

29. An image forming apparatus according to claim 24, wherein said fixing speed is a conveying speed of the transfer material by said fixing means.

30. An image forming apparatus according to claim 4, further comprising fixing means for fixing the image on the transfer material, and wherein said control means controls a peripheral speed of said image bearing member, a peripheral speed of said intermediate transfer member, a conveying speed of the transfer material by said conveying means, and a fixing speed of said fixing means on the basis of the result of the detection by said detecting means.

31. An image forming apparatus according to claim 1, wherein the time period between the time when the image starts to be formed on said image bearing member by said image forming means and the time when the image on said image bearing member formed by said image forming means is transferred to said intermediate transfer member and arrives at said transfer position is longer than a time interval at which a plurality of transfer materials are conveyed to said transfer position by said conveying means.

32. An image forming apparatus according to claim 31, further comprising containing means for containing transfer materials therein and detachably mountable to a main body of the apparatus, and wherein the transfer materials contained in said containing means are conveyed to said transfer position at predetermined timing.

33. An image forming apparatus according to claim 32, wherein after a dismounting and mounting operation of said containing means to the main body of the apparatus is performed, said first mode is selected by said changeover means for a transfer material on which an image is first formed, and said second mode is selected by said changeover means for a transfer material on which an image is formed next.

34. An image forming apparatus according to claim 31, wherein after a power source switch of a main body of the apparatus is closed, said first mode is selected by said changeover means for a transfer material on which an image is first formed, and said second mode is selected by said changeover means for a transfer material on which an image is formed next.

35. An image forming apparatus according to claim 1, further comprising containing means for containing transfer materials therein and detachably mountable to a main body of the apparatus, and wherein the transfer materials contained in said containing means are conveyed to said transfer position at predetermined timing.

36. An image forming apparatus according to claim 35, wherein after a dismounting and mounting operation of said containing means to the main body of the apparatus is performed, said first mode is selected by said changeover means for a transfer material on which an image is first formed, and said second mode is selected by said changeover means for a transfer material on which an image is formed next.

37. An image forming apparatus according to claim 36, wherein after a power source switch of the main body of the apparatus is closed, said first mode is selected by said changeover means for a transfer material on which an image is first formed, and said second mode is selected by said changeover means for a transfer material on which an image is formed next.

38. An image forming apparatus according to claim 1, wherein after a power source switch of a main body of the apparatus is closed, said first mode is selected by said changeover means for a transfer material on which an image is first formed, and said second mode is selected by said changeover means for a transfer material on which an image is formed next.

39. An image forming apparatus according to claim 1, wherein a plurality of image bearing members are provided, and a plurality of image forming means for forming images on said plurality of image bearing members are provided.

40. An image forming apparatus according to claim 39, wherein the images on said plurality of image bearing members formed by said plurality of image forming means are successively transferred to said intermediate transfer member, and the images on said intermediate transfer member are transferred to the transfer material.

41. An image forming apparatus according to claim 40, wherein a time period between a time when the image starts to be formed on a first image bearing member of said plurality of image bearing members on which an image is first formed and a time when the of images are transferred from said plurality of image bearing members to said intermediate transfer member and arrive at said transfer position is longer than the time period between the time when the kind of the transfer material is detected by said detecting means and the time when the transfer material arrives at said transfer position by said conveying means.

42. An image forming apparatus according to claim 1, wherein said conveying means is provided with a pair of rotary members for nipping the transfer material therebetween and conveying it to said transfer position.

43. An image forming apparatus according to claim 42, wherein said pair of rotary members give a conveying force to the transfer material at predetermined timing.

44. An image forming apparatus comprising:

an image bearing member;

image forming means for forming an image on said image bearing member, the image on said image bearing member being transferred to a transfer material at a transfer position;

detecting means for detecting a kind of the transfer material;

conveying means for conveying the transfer material to said transfer position;

wherein a time period between a time when the image starts to be formed on said image bearing member by said image forming means and a time when the image on said image bearing member formed by said image forming means arrives at said transfer position is longer than a time period between a time when the kind of the transfer material is detected by said detecting means and a time when the transfer material arrives at said transfer position by said conveying means; and changeover means for changing over to a first mode for forming the image on said image bearing member by said image forming means on a basis of the kind of the transfer material detected by said detecting means, and a second mode for forming the image on said image bearing member by said image forming means without detecting the kind of the transfer material by said detecting means.

45. An image forming apparatus according to claim 44, further comprising memory means for storing therein information of the kind of the transfer material detected by said detecting means in said first mode.

46. An image forming apparatus according to claim 45, wherein when said second mode is selected, the image is formed on said image bearing member by said image forming means on a basis of the information stored in said memory means.

47. An image forming apparatus according to claim 45, further comprising control means for controlling an image forming condition on a basis of a result of a detection by said detecting means.

48. An image forming apparatus according to claim 47, wherein said image forming means is provided with charging means for charging said image bearing member, and said control means controls a charging condition of said charging means on the basis of the result of the detection by said detecting means.

49. An image forming apparatus according to claim 48, wherein said image forming means is provided with exposing means for exposing said image bearing member charged by said charging means to thereby form a latent image, and said control means controls an exposing condition of said exposing means on the basis of the result of the detection by said detecting means.

50. An image forming apparatus according to claim 49, wherein said image forming means is provided with developing means for developing the latent image on said image bearing member to thereby form a toner image, and said control means controls a developing condition of said developing means on the basis of the result of the detection by said detecting means.

51. An image forming apparatus according to claim 50, wherein a time period between a time when the latent image starts to be formed on said image bearing member by said exposing means and a time when the toner image on said image bearing member formed by said developing means arrives at said transfer position is longer than the time period between the time when the kind of the transfer material is detected by said detecting means and the time when the transfer material arrives at said transfer position by said conveying means.

52. An image forming apparatus according to claim 47, wherein said control means controls a peripheral speed of said image bearing member on the basis of the result of the detection by said detecting means.

53. An image forming apparatus according to claim 52, wherein said detecting means detects whether the transfer material is light-transmissive resin.

54. An image forming apparatus according to claim 53, wherein when the transfer material is light-transmissive resin, said control means changes over the peripheral speed of said image bearing member to a second peripheral speed lower than a first peripheral speed.

55. An image forming apparatus according to claim 52, wherein said detecting means detects a thickness of the transfer material.

56. An image forming apparatus according to claim 55, wherein said control means changes over the peripheral speed of said image bearing member to a second peripheral speed lower than a first peripheral speed on the basis of the result of the detection by said detecting means.

57. An image forming apparatus according to claim 47, wherein said control means controls a conveying speed of the transfer material by said conveying means on the basis of the result of the detection by said detecting means.

58. An image forming apparatus according to claim 57, wherein said detecting means detects whether the transfer material is light-transmissive resin.

59. An image forming apparatus according to claim 58, wherein when the transfer material is light-transmissive resin, said control means changes over the conveying speed of the transfer material by said conveying means to a second conveying speed lower than a first conveying speed.

60. An image forming apparatus according to claim 57, wherein said detecting means detects a thickness of the transfer material.

61. An image forming apparatus according to claim 60, wherein said control means changes over the conveying speed of the transfer material by said conveying means to a second conveying speed lower than a first conveying speed on the basis of the result of the detection by said detecting means.

62. An image forming apparatus according to claim 47, further comprising fixing means for fixing the image on the transfer member, and wherein said control means controls a fixing speed of said fixing means on the basis of the result of the detection by said detecting means.

63. An image forming apparatus according to claim 62, wherein said detecting means detects whether the transfer material is light-transmissive resin.

64. An image forming apparatus according to claim 63, wherein when the transfer material is light-transmissive resin, said control means changes over the fixing speed of said fixing means to a second fixing speed lower than a first fixing speed.

65. An image forming apparatus according to claim 62, wherein said detecting means detects a thickness of the transfer material.

66. An image forming apparatus according to claim 65, wherein said control means changes over the fixing speed of said fixing means to a second fixing speed lower than a first fixing speed on the basis of the result of the detection by said detecting means.

67. An image forming apparatus according to claim 62, wherein said fixing speed is a conveying speed of the transfer material by said fixing means.

68. An image forming apparatus according to claim 47, further comprising fixing means for fixing the image on the transfer material, and wherein said control means controls a peripheral speed of said image bearing member, a peripheral speed of said intermediate transfer member, a conveying speed of the transfer material by said conveying means and a fixing speed of said fixing means on the basis of the result of the detection by said detecting means.

69. An image forming apparatus according to claim 44, further comprising containing means for containing transfer materials therein and detachably mountable a main body of the apparatus, and wherein the transfer materials contained in said containing means are conveyed to said transfer position at predetermined timing.

70. An image forming apparatus according to claim 69, wherein after a dismounting and mounting operation of said containing means to the main body of the apparatus is performed, said first mode is selected by said changeover means for a transfer material on which an image is first formed, and said second mode is selected by said changeover means for a transfer material on which an image is formed next.

71. An image forming apparatus according to claim 70, wherein after a power source switch of the main body of the apparatus is closed, said first mode is selected by said changeover means for a transfer material on which an image is first formed, and said second mode is selected by said changeover means for a transfer material on which an image is formed next.

72. An image forming apparatus according to claim 44, wherein after a power source switch of a main body of the apparatus is closed, said first mode is selected by said changeover means for a transfer material on which an image is first formed, and said second mode is selected by said changeover means for a transfer material on which an image is formed next.

73. An image forming apparatus according to claim 44, wherein said conveying means is provided with a transfer material bearing member for bearing the transfer material thereon and conveying it to said transfer position, and the image on said image bearing member is transferred to the transfer material borne on said transfer material bearing member.

74. An image forming apparatus according to claim 73, wherein said conveying means is provided with a pair of rotary members for nipping the transfer material therebetween and conveying it to convey the transfer material to said transfer material bearing member.

75. An image forming apparatus according to claim 74, wherein said pair of rotary members give a conveying force to the transfer material at predetermined timing.

76. An image forming apparatus comprising:

an image bearing member;

image forming means for forming an image on said image bearing member, the image on said image bearing member being transferred to a transfer material;

detecting means for detecting a kind of the transfer material; and containing means for containing transfer materials therein and detachably mountable to a main body of the apparatus;

wherein after a dismounting and mounting of said containing means to the main body of the apparatus is performed, when an image is to be formed on a first transfer material, the image is formed on said image bearing member by said image forming means on a basis of a result of a detection by said detecting means, and when an image is to be formed on a next transfer material, the image is formed on said image bearing member by said image forming means on the basis of the result of the detection by said detecting means without the kind of the transfer material being detected by said detecting means.

77. An image forming apparatus according to claim 76, further comprising memory means for storing therein information of the kind of the transfer material detected by said detecting means.

78. An image forming apparatus according to claim 77, further comprising control means for controlling an image forming condition on the basis of the result of the detection by said detecting means.

79. An image forming apparatus according to claim 78, wherein said image forming means is provided with charging means for charging said image bearing member, and said control means controls a charging condition of said charging means on the basis of the result of the detection by said detecting means.

80. An image forming apparatus according to claim 79, wherein said image forming means is provided with exposing means for exposing said image bearing member charged by said charging means to thereby form a latent image, and said control means controls an exposing condition of said exposing means on the basis of the result of the detection by said detecting means.

81. An image forming apparatus according to claim 80, wherein said image forming means is provided with developing means for developing the latent image on said image bearing member to thereby form a toner image, and said control means controls a developing condition of said developing means on the basis of the result of the detection by said detecting means.

82. An image forming apparatus according to claim 81, wherein a time period between a time when the latent image starts to be formed on said image bearing member by said exposing means and a time when the image on said image bearing member formed by said developing means arrives at a transfer position whereat it is transferred to the transfer material is longer than the time period between the time when the kind of the transfer material is detected by said detecting means and the time when the transfer material arrives at said transfer position by said conveying means.

83. An image forming apparatus according to claim 78, wherein said control means controls a peripheral speed of said image bearing member on the basis of the result of the detection by said detecting means.

84. An image forming apparatus according to claim 83, wherein said detecting means detects whether the transfer material is light-transmissive resin.

85. An image forming apparatus according to claim 84, wherein when the transfer material is light-transmissive resin, said control means changes over the peripheral speed of said image bearing member to a second peripheral speed lower than a first peripheral speed.

86. An image forming apparatus according to claim 83, wherein said detecting means detects a thickness of the transfer material.

87. An image forming apparatus according to claim 86, wherein said control means changes over the peripheral speed of said image bearing member to a second peripheral speed lower than a first peripheral speed on the basis of the result of the detection by said detecting means.

88. An image forming apparatus according to claim 78, wherein said control means controls a conveying speed of the transfer material by said conveying means on the basis of the result of the detection by said detecting means.

89. An image forming apparatus according to claim 88, wherein said detecting means detects whether the transfer material is light-transmissive resin.

90. An image forming apparatus according to claim 89, wherein when the transfer material is light-transmissive resin, said control means changes over the conveying speed of the transfer material by said conveying means to a second conveying speed lower than a first conveying speed.

91. An image forming apparatus according to claim 88, wherein said detecting means detects a thickness of the transfer material.

92. An image forming apparatus according to claim 91, wherein said control means changes over the conveying speed of the transfer material by said conveying means to a second conveying speed lower than a first conveying speed on the basis of the result of the detection by said detecting means.

93. An image forming apparatus according to claim 78, further comprising fixing means for fixing the image on the transfer material, and wherein said control means controls a fixing speed of said fixing means on the basis of the result of the detection by said detecting means.

94. An image forming apparatus according to claim 93, wherein said detecting means detects whether the transfer material is light-transmissive resin.

95. An image forming apparatus according to claim 94, wherein when the transfer material is light-transmissive resin, said control means changes over the fixing speed of said fixing means to a second fixing speed lower than a first fixing speed.

96. An image forming apparatus according to claim 93, wherein said detecting means detects a thickness of the transfer material.

97. An image forming apparatus according to claim 96, wherein said control means changes over the fixing speed of said fixing means to a second fixing speed lower than a first fixing speed on the basis of the result of the detection by said detecting means.

98. An image forming apparatus according to claim 93, wherein said fixing speed is a conveying speed of the transfer material by said fixing means.

99. An image forming apparatus according to claim 78, further comprising fixing means for fixing the image on the transfer material, and wherein said control means controls a peripheral speed of said image bearing member, a conveying speed of the transfer material by said conveying means, and a fixing speed of said fixing means on the basis of the result of the detection by said detecting means.

100. An image forming apparatus according to claim 76, wherein a time period between a time when the image starts to be formed on said image bearing member by said image forming means and a time when the image on said image bearing member formed by said image forming means arrives at a transfer position whereat it is transferred is longer than a time interval at which a plurality of transfer materials are conveyed to said transfer position by said conveying means.

101. An image forming apparatus according to claim 76, wherein a time period between a time when the image starts to be formed on said image bearing member by said image forming means and a time when the image on said image bearing member formed by said image forming means arrives at a transfer position whereat it is transferred to the transfer material is longer than a time period between a time when the kind of the transfer material is detected by said detecting means and a time when the transfer material arrives at said transfer position by said conveying means.

102. An image forming apparatus according to claim 76, further comprising an intermediate transfer member to which the image on said image bearing member is transferred, and wherein the image on said intermediate transfer member is transferred to the transfer material.

103. An image forming apparatus according to claim 102, wherein a plurality of image bearing members are provided, and a plurality of image forming means are provided to form images on said plurality of image bearing members.

104. An image forming apparatus according to claim 103, wherein the images on said plurality of image bearing members formed by said plurality of image forming means are successively transferred to said intermediate transfer member, and the images on said intermediate transfer member are transferred to the transfer material.

105. An image forming apparatus according to claim 104, wherein a time period between a time when an image starts to be formed on a first image bearing member of said plurality of image bearing members on which the image is first formed and a time when the images on said intermediate transfer member arrive at a transfer position whereat they are transferred to the transfer material is longer than the time period between the time when the kind of the transfer material is detected by said detecting means and the time when the transfer material arrives at said transfer position by said conveying means.

106. An image forming apparatus according to claim 76, wherein said conveying means is provided with a transfer material bearing member for bearing the transfer material thereon and conveying it to said transfer position, and the image on said image bearing member is transferred to the transfer material borne on said transfer material bearing member.

107. An image forming apparatus according to claim 106, wherein said conveying means is provided with a pair of rotary members for nipping the transfer material therebetween and conveying it to convey the transfer material to said transfer material bearing member.

108. An image forming apparatus according to claim 107, wherein said pair of rotary members give a conveying force to the transfer material at predetermined timing.

109. An image forming apparatus according to claim 76, wherein said image bearing member is a photosensitive member.

110. An image forming apparatus comprising:

an image bearing member;

image forming means for forming an image on said image bearing member, the image on said image bearing member being transferred to a transfer material; and detecting means for detecting a kind of the transfer material;

wherein after a power source switch of a main body of the apparatus is closed, when an image is to be formed on a first transfer material, the image is formed on said image bearing member by said image forming means on a basis of a result of a detection by said detecting means, and when an image is to be formed on a next transfer material, the image is formed on said image bearing member by said image forming means on the basis of the result of the detection by said detecting means without the kind of the transfer material being detected by said detecting means.

111. An image forming apparatus according to claim 110, further comprising memory means for storing therein information of the kind of the transfer material detected by said detecting means.

112. An image forming apparatus according to claim 111, further comprising control means for controlling an image forming condition on the basis of the result of the detection by said detecting means.

113. An image forming apparatus according to claim 112, wherein said image forming means is provided with charging means for charging said image bearing member, and said control means controls a charging condition of said charging means on the basis of the result of the detection by said detecting means.

114. An image forming apparatus according to claim 113, wherein said image forming means is provided with exposing means for exposing said image bearing member charged by said charging means to thereby form a latent image, and said control means controls an exposing condition of said exposing means on the basis of the result of the detection by said detecting means.

115. An image forming apparatus according to claim 114, wherein said image forming means is provided with developing means for developing the latent image on said image bearing member to thereby form a toner image, and said control means controls a developing condition of said developing means on the basis of the. result of the detection by said detecting means.

116. An image forming apparatus according to claim 115, wherein a time period between a time when the latent image starts to be formed on said image bearing member by said exposing means and a time when the image on said image bearing member formed by said developing means arrives at a transfer position whereat it is transferred to the transfer material is longer than the time period between the time when the kind of the transfer material is detected by said detecting means and the time when the transfer material arrives at said transfer position by said conveying means.

117. An image forming apparatus according to claim 112, wherein said control means controls a peripheral speed of said image bearing member on the basis of the result of the detection by said detecting means.

118. An image forming apparatus according to claim 117, wherein said detecting means detects whether the transfer material is light-transmissive resin.

119. An image forming apparatus according to claim 118, wherein when the transfer material is light-transmissive resin, said control means changes over the peripheral speed of said image bearing member to a second peripheral speed lower than a first peripheral speed.

120. An image forming apparatus according to claim 117, wherein said detecting means detects a thickness of the transfer material.

121. An image forming apparatus according to claim 120, wherein said control means changes over the peripheral speed of said image bearing member to a second peripheral speed lower than a first peripheral speed on the basis of the result of the detection by said detecting means.

122. An image forming apparatus according to claim 112, wherein said control means controls a conveying speed of the transfer material by said conveying means on the basis of the result of the detection by said detecting means.

123. An image forming apparatus according to claim 122, wherein said detecting means detects whether the transfer material is light-transmissive resin.

124. An image forming apparatus according to claim 123, wherein when the transfer material is light-transmissive resin, said control means changes over the conveying speed of the transfer material by said conveying means to a second conveying speed lower than a first conveying speed.

125. An image forming apparatus according to claim 122, wherein said detecting means detects a thickness of the transfer material.

126. An image forming apparatus according to claim 125, wherein said control means changes over the conveying speed of the transfer material by said conveying means to a second conveying speed lower than a first conveying speed on the basis of the result of the detection by said detecting means.

127. An image forming apparatus according to claim 112, further comprising fixing means for fixing the image on the transfer material, and wherein said control means controls a fixing speed of said fixing means on the basis of the result of the detection by said detecting means.

128. An image forming apparatus according to claim 127, wherein said detecting means detects whether the transfer material is light-transmissive resin.

129. An image forming apparatus according to claim 128, wherein when the transfer material is light-transmissive resin, said control means changes over the fixing speed of said fixing means to a second fixing speed lower than a first fixing speed.

130. An image forming apparatus according to claim 127, wherein said detecting means detects a thickness of the transfer material.

131. An image forming apparatus according to claim 130, wherein said control means changes over the fixing speed of said fixing means to a second fixing speed lower than a first fixing speed on the basis of the result of the detection by said detecting means.

132. An image forming apparatus according to claim 127, wherein said fixing speed is a conveying speed of the transfer material by said fixing means.

133. An image forming apparatus according to claim 112, further comprising fixing means for fixing the image on the transfer material, and wherein said control means controls a peripheral speed of said image bearing member, a conveying speed of the transfer material by said conveying means, and a fixing speed of said fixing means on the basis of the result of the detection by said detecting means.

134. An image forming apparatus according to claim 110, wherein a time period between a time when the image starts to be formed on said image bearing member by said image forming means and a time when the image on said image bearing member formed by said image forming means arrives at a transfer position whereat it is transferred is longer than a time interval at which a plurality of transfer materials are conveyed to said transfer position by said conveying means.

135. An image forming apparatus according to claim 110, wherein a time period between a time when the image starts to be formed on said image bearing member by said image forming means and a time when the image on said image bearing member formed by said image forming means arrives at a transfer position whereat it is transferred to the transfer material is longer than a time period between a time when the kind of the transfer material is detected by said detecting means and a time when the transfer material arrives at said transfer position by said conveying means.

136. An image forming apparatus according to claim 110, further comprising an intermediate transfer member to which the image on said image bearing member is transferred, and wherein the image on said intermediate transfer member is transferred to the transfer material.

137. An image forming apparatus according to claim 136, wherein a plurality of image bearing members are provided, and a plurality of image forming means are provided to form images on said image bearing members.

138. An image forming apparatus according to claim 137, wherein the images on said plurality of image bearing members formed by said plurality of image forming means are successively transferred to said intermediate transfer member, and the images on said intermediate transfer member are transferred to the transfer material.

139. An image forming apparatus according to claim 138, wherein a time period between a time when an image starts to be formed on a first image bearing member of said plurality of image bearing members on which the image is first formed and a time when the images on said intermediate transfer member arrive at a transfer position whereat they are transferred to the transfer material is longer than a time period between a time when the kind of the transfer material is detected by said detecting means and a time when the transfer material arrives at said transfer position by said conveying means.

140. An image forming apparatus according to claim 110, wherein said conveying means is provided with a transfer material bearing member for bearing the transfer material thereon and conveying it to said transfer position, and the image on said image bearing member is transferred to the transfer material borne on said transfer material bearing member.

141. An image forming apparatus according to claim 140, wherein said conveying means is provided with a pair of rotary members for nipping the transfer material therebetween and conveying it to convey the transfer material to said transfer material bearing member.

142. An image forming apparatus according to claim 141, wherein said pair of rotary members give a conveying force to the transfer material at predetermined timing.

143. An image forming apparatus according to claim 110, wherein said image bearing member is a photosensitive member.

144. An image forming apparatus comprising:

an image bearing member;

image forming means for forming an image on said image bearing member;

an intermediate transfer member to which the image is transferred from said image bearing member, the image on said intermediate transfer member being transferred to a transfer material at a transfer position;

detecting means for detecting a kind of the transfer material; and changeover means for selectively changing over a first mode for forming the image on said image bearing member by said image forming means on a basis of the kind of the transfer material detected by said detecting means, and a second mode for forming the image on said image bearing member by said image forming means on a basis of a result of a detection by said detecting means in said first mode irrespective of whether or not kind of the transfer material is detected by said detecting means.

145. An image forming apparatus according to claim 144, further comprising memory means for storing information of the kind of the transfer material detected by said detecting means in said first mode.

146. An image forming apparatus according to claim 145, wherein when said second mode is selected, the image is formed on said image bearing member by said image forming means on a basis of the information stored in said memory means.

147. An image forming apparatus according to claim 145, further comprising control means for controlling an image forming condition on the basis of the result of the detection by said detecting means.

148. An image forming apparatus according to claim 147, wherein said image forming means is provided with charging means for charging said image bearing member, and said control means controls a charging condition of said charging means on the basis of the result of the detection by said detecting means.

149. An image forming apparatus according to claim 148, wherein said image forming means is provided with exposing means for exposing said image bearing member charged by said charging means to thereby form a latent image, and said control means controls an exposing condition of said exposing means on the basis of the result of the detection by said detecting means.

150. An image forming apparatus according to claim 149, wherein said image forming means is provided with developing means for developing the latent image on said image bearing member to thereby form a toner image, and said control means controls a developing condition of said developing means on the basis of the result of the detection by said detecting means.

151. An image forming apparatus according to claim 150, wherein a time period between a time when the latent image starts to be formed on said image bearing member by said exposing means and a time when the toner image on said image bearing member formed by said developing means is transferred to said intermediate transfer member and arrives at said transfer position is longer than a time period between a time period between a time when the kind of the transfer material is directed by said detecting means and a time when the transfer material arrives at said transfer position.

152. An image forming apparatus according to claim 147, wherein said control means controls a peripheral speed of said image bearing member on the basis of the result of the detection by said detecting means.

153. An image forming apparatus according to claim 152, wherein said detecting means detects whether the transfer material is a light-transmissive resin.

154. An image forming apparatus according to claim 153, wherein when the transfer material is a light-transmissive resin, said control means changes over the peripheral speed of said image bearing member to a second peripheral speed lower than a first peripheral speed.

155. An image forming apparatus according to claim 152, wherein said detecting means detects a thickness of the transfer material.

156. An image forming apparatus according to claim 155, wherein said control means changes over the peripheral speed of said image bearing member to a second peripheral speed lower than a first peripheral speed on the basis of the result of the detection by said detecting means.

157. An image forming apparatus according to claim 147, wherein said control means controls a peripheral speed of said intermediate transfer member on the basis of the result of the detection by said detecting means.

158. An image forming apparatus according to claim 157, wherein said detecting means detects whether the transfer material is a light-transmissive resin.

159. An image forming apparatus according to claim 158, wherein when the transfer material is a light-transmissive resin, said control means changes over the peripheral speed of said intermediate transfer member to a second peripheral speed lower than a first peripheral speed.

160. An image forming apparatus according to claim 157, wherein said detecting means detects a thickness of the transfer material.

161. An image forming apparatus according to claim 160, wherein said control means changes over the peripheral speed of said intermediate transfer member to a second peripheral speed lower than a first peripheral speed on the basis of the result of the detection by said detecting means.

162. An image forming apparatus according to claim 147, wherein said control means controls a conveying speed of the transfer material on the basis of the result of the detection by said detecting means.

163. An image forming apparatus according to claim 162, wherein said detecting means detects whether the transfer material is a light-transmissive resin.

164. An image forming apparatus according to claim 163, wherein when the transfer material is a light-transmissive resin, said control means changes over the conveying speed of the transfer material to a second conveying speed lower than a first conveying speed.

165. An image forming apparatus according to claim 162, wherein said detecting means detects a thickness of the transfer material.

166. An image forming apparatus according to claim 165, wherein said control means changes over the conveying speed of the transfer material to a second conveying speed lower than a first conveying speed on the basis of the result of the detection by said detecting means.

167. An image forming apparatus according to claim 147, further comprising fixing means for fixing the image on the transfer material, and wherein said control means controls a fixing speed of said fixing means on the basis of the result of the detection by said detecting means.

168. An image forming apparatus according to claim 167, wherein said detecting means detects whether the transfer material is a light-transmissive resin.

169. An image forming apparatus according to claim 168, wherein when the transfer material is a light-transmissive resin, said control means changes over the fixing speed of said fixing means to a second fixing speed lower than a first fixing speed.

170. An image forming apparatus according to claim 167, wherein said detecting means detects a thickness of the transfer material.

171. An image forming apparatus according to claim 170, wherein said control means changes over the fixing speed of said fixing means to a second fixing speed lower than a first fixing speed on the basis of the result of the detection by said detecting means.

172. An image forming apparatus according to claim 167, wherein said fixing speed is a conveying speed of the transfer material by said fixing means.

173. An image forming apparatus according to claim 147, further comprising fixing means for fixing the image on the transfer material, and wherein said control means controls a peripheral speed of said image bearing member, a peripheral speed of said intermediate transfer member, a conveying speed of the transfer material, and a fixing speed of said fixing means on the basis of the result of the detection by said detecting means.

174. An image forming apparatus according to claim 144, wherein a time period between a time when the image starts to be formed on said image bearing member by said image forming means and a time when the image on said image bearing member formed by said image forming means is transferred to said intermediate transfer member and arrives at said transfer position is longer than a time interval at which a plurality of transfer materials are conveyed to said transfer position.

175. An image forming apparatus according to claim 174, further comprising containing means for containing transfer materials therein and detachably mountable to a main body of the apparatus, and wherein the transfer materials contained in said containing means are conveyed to said transfer position at a predetermined timing.

176. An image forming apparatus according to claim 175, wherein after a dismounting and mounting operation of said containing means to the main body of the apparatus is performed, said first mode is selected by said changeover means for a transfer material on which an image is first formed, and said second mode is selected by said changeover means for a transfer material on which an image is formed next.

177. An image forming apparatus according to claim 174, wherein after a power source switch of a main body of the apparatus is closed, said first mode is selected by said changeover means for a transfer material on which an image is first formed, and said second mode is selected by said changeover means for a transfer material on which an image is formed next.

178. An image forming apparatus according to claim 144, further comprising containing mens for containing transfer materials therein and detachably mountable to a main body of the apparatus, and wherein the transfer materials contained in said containing means are conveyed to said transfer position at predetermined timing.

179. An image forming apparatus according to claim 178, wherein after a dismounting and mounting operation of said containing means to the main body of the apparatus is performed, said first mode is selected by said changeover means for a transfer material on which an image is first formed, and said second mode is selected by said changeover means for a transfer material on which an image is formed next.

180. An image forming apparatus according to claim 179, wherein after a power source switch of the main body of the apparatus is closed, said first mode is selected by said changeover means for a transfer material on which an image is first formed, and said second mode is selected by said changeover means for a transfer material on which an image is formed next.

181. An image forming apparatus according to claim 144, wherein after a power source switch of a main body of the apparatus is closed, said first mode is selected by said changeover means for a transfer material on which an image is first formed, and said second mode is selected by said changeover means for a transfer material on which an image is formed next.

182. An image forming apparatus according to claim 144, wherein a plurality of image bearing members are provided, and a plurality of image forming means for forming images on said plurality of image bearing members are provided.

183. An image forming apparatus according to claim 182, wherein the images on said plurality of image bearing members formed by said plurality of image forming means are successively transferred to said intermediate transfer member, and the images on said intermediate transfer member are transferred to the transfer material.

184. An image forming apparatus according to claim 183, wherein a time period between a time when the image starts to be formed on a first image bearing member of said plurality of image bearing members on which an image is first formed and a time when the images are transferred from said plurality of image bearing members to said intermediate transfer member and arrive at said transfer position is longer than a time period between a time when the kind of the transfer material is detected by said detecting means and a time when the transfer material arrives at said transfer position.

185. An image forming apparatus according to claim 184, further comprising a pair of rotary members for nipping the transfer material therebetween and conveying it to said transfer position.

186. An image forming apparatus according to claim 185, wherein said pair of rotary members give a conveying force to the transfer material at predetermined timing.

187. An image forming apparatus comprising:

an image bearing member;

image forming means for forming an image on said image bearing member, the image on said image bearing member being transferred to a transfer material at a transfer position;

detecting means for detecting a kind of the transfer material; and changeover means for changing over to a first mode for forming the image on said image bearing member by said image forming means on a basis of the kind of the transfer material detected by said detecting means, and a second mode for forming the image on said image bearing member by said image forming means without detecting the kind of the transfer material by said detecting means.

188. An image forming apparatus according to claim 187, further comprising memory means for storing information of the kind of the transfer material detected by said detecting means in said first mode.

189. An image forming apparatus according to claim 188, wherein when said second mode is selected, the image is formed on said image bearing member by said image forming means on a basis of the information stored in said memory means.

190. An image forming apparatus according to claim 188, further comprising control means for controlling an image forming condition on a basis of a result of a detection by said detecting means.

191. An image forming apparatus according to claim 190, wherein said image forming means is provided with charging means for charging said image bearing member, and said control means controls a charging condition of said charging means on the basis of the result of the detection by said detecting means.

192. An image forming apparatus according to claim 191, wherein said image forming means is provided with exposing means for exposing said image bearing member charged by said charging means to thereby form a latent image, and said control means controls an exposing condition of said exposing means on the basis of the result of the detection by said detecting means.

193. An image forming apparatus according to claim 192, wherein said image forming means is provided with developing means for developing the latent image on said image bearing member to thereby form a toner image, and said control means controls a developing condition of said developing means on the basis of the result of the detection by said detecting means.

194. An image forming apparatus according to claim 193, wherein a time period between a time when the latent image starts to be formed on said image bearing member by said exposing means and a time when the toner image on said image bearing member formed by said developing means arrives at said transfer position is longer than a time period between a time when the kind of the transfer material is detected by said detecting means and a time when the transfer material arrives at said transfer position.

195. An image forming apparatus according to claim 190, wherein said control means controls a peripheral speed of said image bearing member on the basis of the result of the detection by said detecting means.

196. An image forming apparatus according to claim 195, wherein said detecting means detects whether the transfer material is a light-transmissive resin.

197. An image forming apparatus according to claim 196, wherein when the transfer material is a light-transmissive resin, said control means changes over the peripheral speed of said image bearing member to a second peripheral speed lower than a first peripheral speed.

198. An image forming apparatus according to claim 195, wherein said detecting means detects a thickness of the transfer material.

199. An image forming apparatus according to claim 198, wherein said control means changes over the peripheral speed of said image bearing member to a second peripheral speed lower than a first peripheral speed on the basis of the result of the detection by said detecting means.

200. An image forming apparatus according to claim 190, wherein said control means controls a conveying speed of the transfer material on the basis of the result of the detection by said detecting means.

201. An image forming apparatus according to claim 200, wherein said detecting means detects whether the transfer material is a light-transmissive resin.

202. An image forming apparatus according to claim 201, wherein when the transfer material is a light-transmissive resin, said control means changes over the conveying speed of the transfer material to a second conveying speed lower than a first conveying speed.

203. An image forming apparatus according to claim 200, wherein said detecting means detects a thickness of the transfer material.

204. An image forming apparatus according to claim 203, wherein said control means changes over the conveying speed of the transfer material to a second conveying speed lower than a first conveying speed on the basis of the result of the detection by said detecting means.

205. An image forming apparatus according to claim 190, further comprising fixing means for fixing the image on the transfer member, and wherein said control means controls a fixing speed of said fixing means on the basis of the result of the detection by said detecting means.

206. An image forming apparatus according to claim 205, wherein said detecting means detects whether the transfer material is light-transmissive resin.

207. An image forming apparatus according to claim 206, wherein when the transfer material is light-transmissive resin, said control means changes over the fixing speed of said fixing means to a second fixing speed lower than a first fixing speed.

208. An image forming apparatus according to claim 205, wherein said detecting means detects a thickness of the transfer material.

209. An image forming apparatus according to claim 208, wherein said control means changes over the fixing speed of said fixing means to a second fixing speed lower than a first fixing speed on the basis of the result of the detection by said detecting means.

210. An image forming apparatus according to claim 205, wherein said fixing speed is a conveying speed of the transfer material by said fixing means.

211. An image forming apparatus according to claim 190, further comprising fixing means for fixing the image on the transfer material, and wherein said control means controls a peripheral speed of said image bearing member, a peripheral speed of said intermediate transfer member, a conveying speed of said intermediate transfer member, a conveying speed of the transfer material and a fixing speed of said fixing means on the basis of the result of the detection by said detecting means.

212. An image forming apparatus according to claim 187, further comprising containing means for containing transfer materials therein and detachably mountable a main body of the apparatus, and wherein the transfer materials contained in said containing means are conveyed to said transfer position at predetermined timing.

213. An image forming apparatus according to claim 212, wherein after a dismounting and mounting operation of said containing means to the main body of the apparatus is performed, said first mode is selected by said changeover means for a transfer material on which an image is first formed, and said second mode is selected by said changeover means for a transfer material on which an image is formed next.

214. An image forming apparatus according to claim 213, wherein after a power source switch of the main body o the apparatus is closed, said first mode is selected by said changeover means for a transfer material on which an image is first formed, and said second mode is selected by said changeover means for a transfer material on which an image is formed next.

215. An image forming apparatus according to claim 187, wherein after a power source switch of a main body of the apparatus is closed, said first mode is selected by said changeover means for a transfer material on which an image is first formed, and said second mode is selected by said changeover means for a transfer material on which an image is formed next.

216. An image forming apparatus according to claim 187, further comprising a transfer material bearing member for bearing the transfer material thereon and conveying it to said transfer position, and the image on said image bearing member is transferred to the transfer material borne on said transfer material bearing member.

217. An image forming apparatus according to claim 216, further comprising a pair of rotary members for nipping the transfer material therebetween and conveying it to convey the transfer material to said transfer material bearing member.

218. An image forming apparatus according to claim 217, wherein said pair of rotary members give a conveying force to the transfer material at predetermined timing.

* * * * *

UNITED STATES PATENT AND TRADEMARK OFFICE

CERTIFICATE OF CORRECTION

PATENT NO. : 6,301,452 B1
DATED : October 9, 2001
INVENTOR(S) : Ryuichi Yoshizawa It is certified that error appears in the above-identified patent and that said Letters Patent is hereby corrected as shown below:

Column 11,
Line 64, "Judged" should read -- judged --.

Column 25,
Line 33, "kind" should read -- the kind --.

Column 27,
Line 55, "mens" should read -- means --.

Column 30,
Line 56, "o" should read -- of --.

Signed and Sealed this

Thirtieth Day of April, 2002

*Attest:*

*Attesting Officer*

JAMES E. ROGAN
*Director of the United States Patent and Trademark Office*